US009773470B2

(12) United States Patent
Kurokawa et al.

(10) Patent No.: US 9,773,470 B2
(45) **Date of Patent: *Sep. 26, 2017**

(54) DISPLAY DEVICE, METHOD OF DRIVING DISPLAY DEVICE, AND ELECTRONIC APPARATUS

(71) Applicant: Japan Display Inc., Tokyo (JP)

(72) Inventors: Tae Kurokawa, Tokyo (JP); Akira Sakaigawa, Tokyo (JP); Masaaki Kabe, Tokyo (JP); Kojiro Ikeda, Tokyo (JP); Fumitaka Gotoh, Tokyo (JP); Amane Higashi, Tokyo (JP); Toshiyuki Nagatsuma, Tokyo (JP)

(73) Assignee: Japan Display Inc., Tokyo (JP)

( * ) Notice: Subject to any disclaimer, the term of this patent is extended or adjusted under 35 U.S.C. 154(b) by 214 days.

This patent is subject to a terminal disclaimer.

(21) Appl. No.: 14/685,791

(22) Filed: Apr. 14, 2015

(65) Prior Publication Data

US 2015/0294642 A1 Oct. 15, 2015

(30) Foreign Application Priority Data

Apr. 15, 2014 (JP) ..... 2014-084041

(51) Int. Cl.
*G09G 5/02* (2006.01)
*G09G 3/36* (2006.01)

(52) U.S. Cl.
CPC ..... *G09G 5/02* (2013.01); *G09G 3/3611* (2013.01); *G09G 2340/0457* (2013.01); *G09G 2340/06* (2013.01)

(58) Field of Classification Search
CPC .... G09G 5/02; G09G 3/3611; G09G 2340/06; G09G 2340/0457; G09G 3/3607; G09G 3/2092; G09G 2340/00; G09G 2300/0452
(Continued)

(56) References Cited

U.S. PATENT DOCUMENTS 8,194,094 B2 6/2012 Sakaigawa et al.
8,432,412 B2 4/2013 Sakaigawa et al.
(Continued)

FOREIGN PATENT DOCUMENTS

CN 1949882 A 4/2007
CN 101006484 A 7/2007
(Continued)

OTHER PUBLICATIONS

Chinese Office Action (with English translation) issued Mar. 9, 2017 in corresponding Chinese application No. 201510172940.3 (14 pages).

*Primary Examiner* — Rodney Amadiz
(74) *Attorney, Agent, or Firm* — K&L Gates LLP

(57) ABSTRACT

A display device includes: an image display panel including a plurality of pixels each including first to fourth sub-pixels; and a signal processing unit. The signal processing unit determines an expansion coefficient related to the image display panel, obtains output signals of the first to the third sub-pixels based on at least input signals of the first to the third sub-pixels and the expansion coefficient to be output to the first to the third sub-pixels respectively, obtains a fourth sub-pixel correction value as a correction value of an output signal of the fourth sub-pixel based on the input signals of the first to the third sub-pixels and the expansion coefficient, and obtains the output signal of the fourth sub-pixel based on the input signals of the first to third sub-pixels, the expansion coefficient, and the fourth sub-pixel correction value to be output to the fourth sub-pixel.

13 Claims, 13 Drawing Sheets

(58) Field of Classification Search
USPC ..... 345/690–694
See application file for complete search history.

(56) References Cited

U.S. PATENT DOCUMENTS

| | | | | |
|---|---|---|---|---|
| 8,743,156 | B2 | 6/2014 | Higashi et al. | |
| 2007/0085863 | A1 | 4/2007 | Moriya et al. | |
| 2008/0316235 | A1 | 12/2008 | Okazaki et al. | |
| 2009/0002298 | A1 | 1/2009 | Furukawa | |
| 2009/0315921 | A1 | 12/2009 | Sakaigawa et al. | |
| 2013/0027441 | A1* | 1/2013 | Kabe | G09G 3/3413 345/690 |
| 2013/0241810 | A1 | 9/2013 | Higashi et al. | |
| 2015/0332643 | A1* | 11/2015 | Higashi | G09G 3/3607 345/694 |
| 2015/0348477 | A1* | 12/2015 | Kabe | G09G 3/3607 345/88 |
| 2015/0348501 | A1* | 12/2015 | Mitsui | G09G 5/02 345/690 |
| 2016/0196787 | A1* | 7/2016 | Kabe | G09G 3/3607 345/694 |

FOREIGN PATENT DOCUMENTS

| | | | |
|---|---|---|---|
| CN | 101615385 | A | 12/2009 |
| JP | 2012-108518 | | 6/2012 |

* cited by examiner

DISPLAY DEVICE, METHOD OF DRIVING DISPLAY DEVICE, AND ELECTRONIC APPARATUS

CROSS REFERENCES TO RELATED APPLICATIONS

The present application claims priority to Japanese Priority Patent Application JP 2014-084041 filed in the Japan Patent Office on Apr. 15, 2014, the entire content of which is hereby incorporated by reference.

BACKGROUND

1. Technical Field

The present disclosure relates to a display device, a method of driving the display device, and an electronic apparatus including the display device.

2. Description of the Related Art

In recent years, demand has been increased for display devices for a mobile apparatus such as a cellular telephone and electronic paper. In such display devices, one pixel includes a plurality of sub-pixels that output light of different colors. Various colors are displayed using one pixel by switching ON/OFF of display of the sub-pixels. Display characteristics such as resolution and luminance have been improved year after year in such display devices. However, an aperture ratio is reduced as the resolution increases, so that luminance of a backlight needs to be increased to achieve high luminance, which leads to increase in power consumption of the backlight. To solve this problem, a technique has been developed for adding a white pixel serving as a fourth sub-pixel to red, green, and blue sub-pixels known in the art (for example, refer to Japanese Patent Application Laid-open Publication No. 2012-108518). According to this technique, the white pixel enhances the luminance to lower a current value of the backlight and reduce the power consumption.

The white pixel has higher luminance than that of other color pixels such as red, green, and blue pixels. Accordingly, when a luminance difference between the white pixel and the other color pixel adjacent thereto is large, a boundary between the white pixel and the other color pixel adjacent thereto may be visually recognized, which leads to deterioration in display quality.

For the foregoing reasons, there is a need for a display device that suppresses deterioration in display quality, a method of driving the display device, and an electronic apparatus including the display device.

SUMMARY

According to an aspect, a display device includes: an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that converts an input value of an input signal into an extended value in a color space extended with the first color, the second color, the third color, and the fourth color to be generated, and outputs a generated output signal to the image display panel. The signal processing unit determines an expansion coefficient related to the image display panel, obtains an output signal of the first sub-pixel based on at least an input signal of the first sub-pixel and the expansion coefficient to be output to the first sub-pixel, obtains an output signal of the second sub-pixel based on at least an input signal of the second sub-pixel and the expansion coefficient to be output to the second sub-pixel, obtains an output signal of the third sub-pixel based on at least an input signal of the third sub-pixel and the expansion coefficient to be output to the third sub-pixel, obtains a fourth sub-pixel correction value as a correction value of an output signal of the fourth sub-pixel based on the input signal of the first sub-pixel, the input signal of the second sub-pixel, the input signal of the third sub-pixel, and the expansion coefficient, and obtains the output signal of the fourth sub-pixel based on the input signal of the first sub-pixel, the input signal of the second sub-pixel, the input signal of the third sub-pixel, the expansion coefficient, and the fourth sub-pixel correction value to be output to the fourth sub-pixel.

According to another aspect, an electronic apparatus includes: a display device; and a control device that supplies an input signal to the display device. The display device includes: an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that converts an input value of the input signal into an extended value in a color space extended with the first color, the second color, the third color, and the fourth color to be generated, and outputs a generated output signal to the image display panel. The signal processing unit determines an expansion coefficient related to the image display panel, obtains an output signal of the first sub-pixel based on at least an input signal of the first sub-pixel and the expansion coefficient to be output to the first sub-pixel, obtains an output signal of the second sub-pixel based on at least an input signal of the second sub-pixel and the expansion coefficient to be output to the second sub-pixel, obtains an output signal of the third sub-pixel based on at least an input signal of the third sub-pixel and the expansion coefficient to be output to the third sub-pixel, obtains a fourth sub-pixel correction value as a correction value of an output signal of the fourth sub-pixel based on the input signal of the first sub-pixel, the input signal of the second sub-pixel, the input signal of the third sub-pixel, and the expansion coefficient, and obtains the output signal of the fourth sub-pixel based on the input signal of the first sub-pixel, the input signal of the second sub-pixel, the input signal of the third sub-pixel, the expansion coefficient, and the fourth sub-pixel correction value to be output to the fourth sub-pixel.

According to still another aspect, a method of driving a display device, the display device including an image display panel including a plurality of pixels each including a first sub-pixel that displays a first color, a second sub-pixel that displays a second color, a third sub-pixel that displays a third color, and a fourth sub-pixel that displays a fourth color, the method includes: obtaining an output signal of each of the first sub-pixel, the second sub-pixel, the third sub-pixel, and the fourth sub-pixel; and controlling an operation of each of the first sub-pixel, the second sub-pixel, the third sub-pixel, and the fourth sub-pixel based on the output signal. At obtaining the output signal, an expansion coefficient related to the image display panel is determined, the output signal of the first sub-pixel is obtained based on at least an input signal of the first sub-pixel and the expansion coefficient, the output signal of the second sub-pixel is obtained based on at least an input signal of the second sub-pixel and the expansion coefficient, the output signal of the third sub-pixel is obtained based on at least an input signal of the third sub-pixel and the expansion coefficient, a fourth sub-pixel correction value as a correction value of an output signal of the fourth sub-pixel is obtained based on the input signal of the first sub-pixel, the input signal of the second sub-pixel, the input signal of the third sub-pixel, and the expansion coefficient, and the output signal of the fourth sub-pixel is obtained based on the input signal of the first sub-pixel, the input signal of the second sub-pixel, the input signal of the third sub-pixel, the expansion coefficient, and the fourth sub-pixel correction value.

Additional features and advantages are described herein, and will be apparent from the following Detailed Description and the figures.

DETAILED DESCRIPTION

Figure 1:
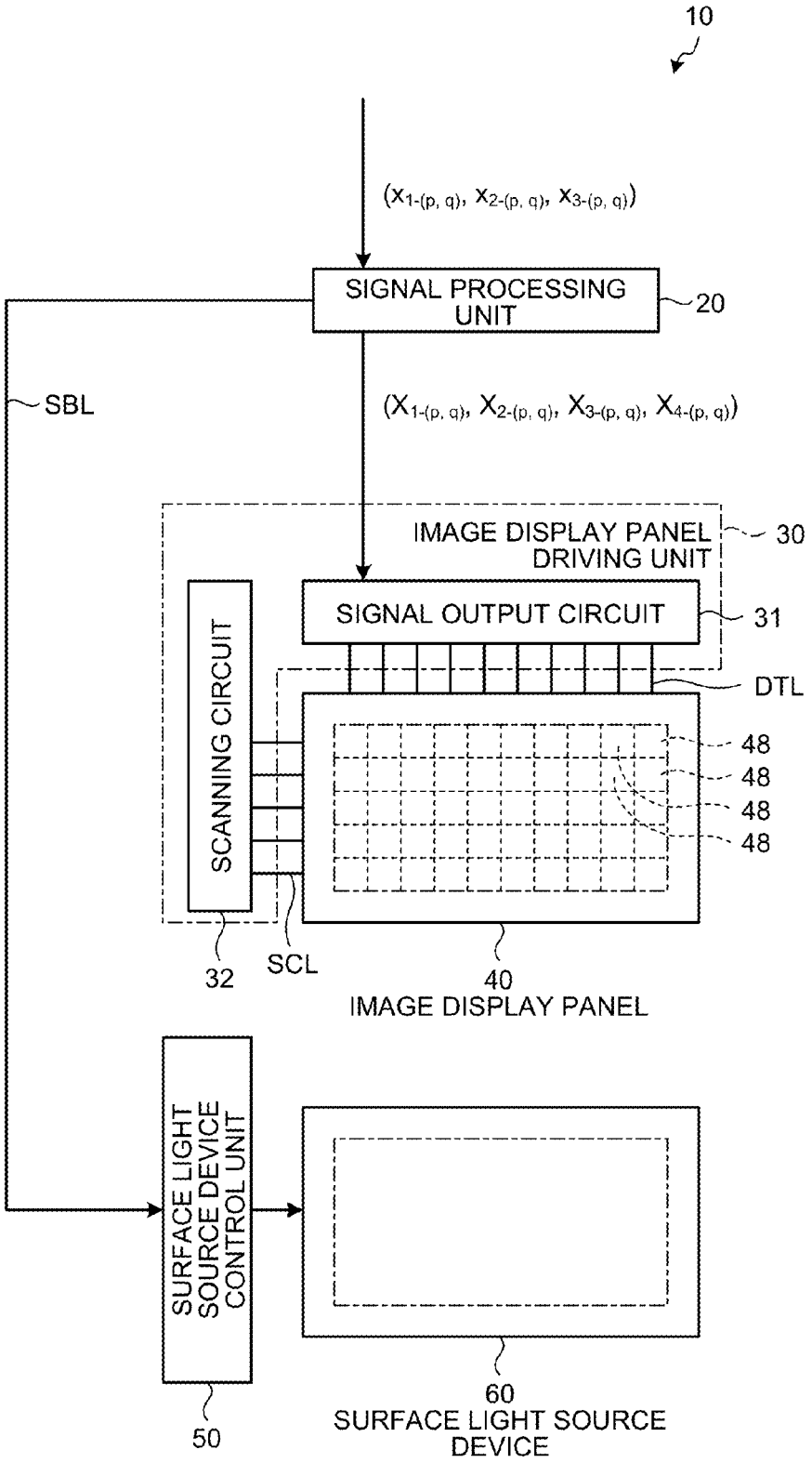
FIG. 1 is a block diagram illustrating an example of a configuration of a display device according to an embodiment.

The following describes an embodiment of the present disclosure in detail in the following order with reference to the drawings.

1. Embodiment
2. Application examples

1. Embodiment

The following describes the embodiment of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

Configuration of Display Device

Figure 2:
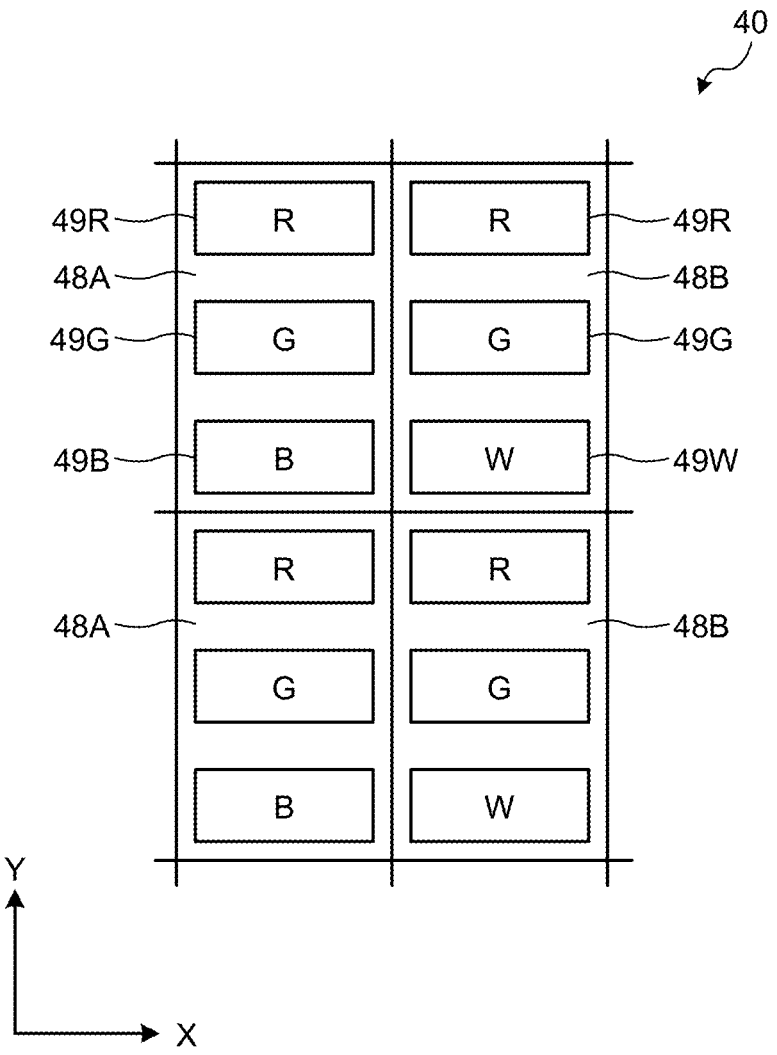
FIG. 2 is a diagram illustrating a pixel array of an image display panel according to the embodiment.
Figure 3:
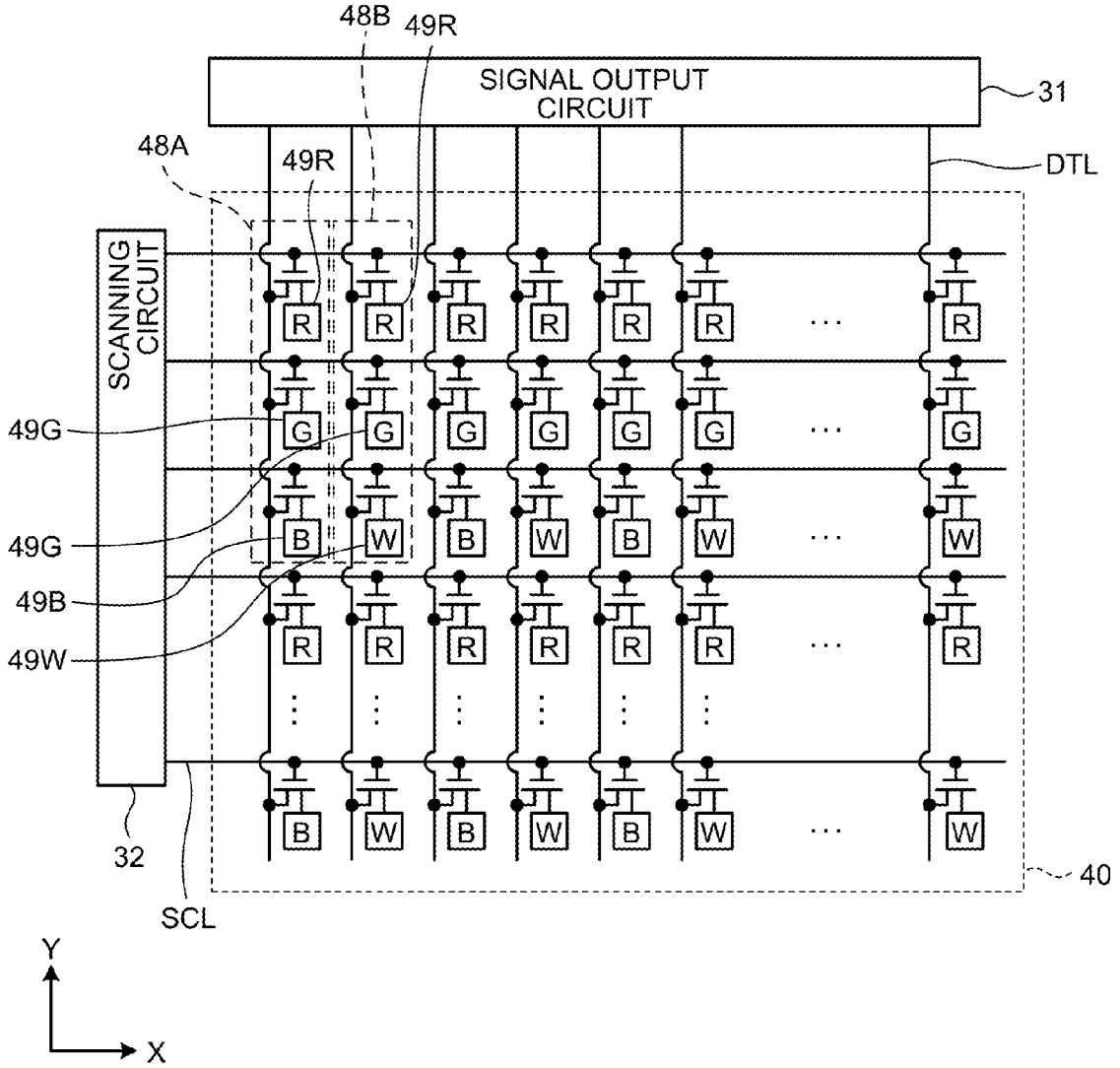
FIG. 3 is a conceptual diagram of the image display panel and an image display panel driving unit according to the embodiment.

FIG. 1 is a block diagram illustrating an example of a configuration of a display device according to the embodiment. FIG. 2 is a diagram illustrating a pixel array of an image display panel according to the embodiment. FIG. 3 is a conceptual diagram of the image display panel and an image display panel driving unit according to the embodiment. As illustrated in FIG. 1, a display device 10 according to the embodiment includes a signal processing unit 20, an image display panel driving unit 30, an image display panel 40, a surface light source device control unit 50, and a surface light source device 60. In the display device 10, the signal processing unit 20 transmits a signal to each component of the display device 10, the image display panel driving unit 30 controls driving of the image display panel 40 based on the signal from the signal processing unit 20, the image display panel 40 causes an image to be displayed based on the signal from the image display panel driving unit 30, the surface light source device control unit 50 controls driving of the surface light source device 60 based on the signal from the signal processing unit 20, and the surface light source device 60 illuminates the image display panel 40 from a back surface thereof based on the signal of the surface light source device control unit 50 to display the image. The display device 10 has a configuration similar to that of an image display device assembly disclosed in Japanese Patent Application Laid-open Publication No. 2011-154323 (JP-A-2011-154323), and various modifications disclosed in JP-A-2011-154323 can be applied to the display device 10.

As illustrated in FIGS. 2 and 3, pixels 48 are arranged in a two-dimensional matrix of $P_0 \times Q_0$($P_0$ in a row direction, and $Q_0$ in a column direction) in the image display panel 40. FIGS. 2 and 3 illustrate an example in which the pixels 48 are arranged in a matrix on an XY two-dimensional coordinate system. In this example, the row direction is the X-axis direction and the column direction is the Y-axis direction. Alternatively, the row direction may be the Y-axis direction, and the column direction may be the X-axis direction.

Each of the pixels 48 includes a first sub-pixel 49R, a second sub-pixel 49G, a third sub-pixel 49B, or a fourth sub-pixel 49W. The first sub-pixel 49R displays a first primary color (for example, red). The second sub-pixel 49G displays a second primary color (for example, green). The third sub-pixel 49B displays a third primary color (for example, blue). The fourth sub-pixel 49W displays a fourth color (for example, white). In the following description, the first sub-pixel 49R, the second sub-pixel 49G, the third sub-pixel 49B, and the fourth sub-pixel 49W may be collectively referred to as a sub-pixel 49 when they are not required to be distinguished from each other.

More specifically, the display device 10 is a transmissive color liquid crystal display device. The image display panel 40 is a color liquid crystal display panel in which a first color filter that allows the first primary color to pass through is arranged between the first sub-pixel 49R and an image observer, a second color filter that allows the second primary color to pass through is arranged between the second sub-pixel 49G and the image observer, and a third color filter that allows the third primary color to pass through is arranged between the third sub-pixel 49B and the image observer. In the image display panel 40, there is no color filter between the fourth sub-pixel 49W and the image observer. A transparent resin layer may be provided for the fourth sub-pixel 49W instead of the color filter. In this way, by arranging the transparent resin layer, the image display panel 40 can suppress the occurrence of a large unevenness in color around the fourth sub-pixel 49W, otherwise the large unevenness in color occurs because of arranging no color filter for the fourth sub-pixel 49W.

In the image display panel 40, pixels 48A and pixels 48B are arranged in a matrix in which the sub-pixels including the first sub-pixel 49R, the second sub-pixel 49G, and the third sub-pixel 49B or the fourth sub-pixel 49W are combined. As illustrated in FIGS. 2 and 3, in the image display panel 40, the pixels 48A each including the first sub-pixel 49R, the second sub-pixel 49G, and the third sub-pixel 49B and the pixels 48B each including the first sub-pixel 49R, the second sub-pixel 49G, and the fourth sub-pixel 49W are alternately arranged in the X-axis direction. In the image display panel 40, the pixels 48A are arranged in the Y-axis direction, and the pixels 48B are arranged in the Y-axis direction. In the image display panel 40, a first row, a second row, and a third row are repeatedly arranged. That is, the second row is arranged next to the first row, the third row is arranged next to the second row, and the second row is arranged between the first row and the third row. In the first row, first sub-pixels 49R are arranged, and in the second row, second sub-pixels 49G are arranged. In the third row, third sub-pixels 49B and fourth sub-pixels 49W are alternately arranged in the row direction. As illustrated in FIG. 2, each of the first sub-pixel 49R, the second sub-pixel 49G, the third sub-pixel 49B, and the fourth sub-pixel 49W forms a rectangular shape the length of which in the X-axis direction is larger than that in the Y-axis direction.

Generally, a pixels' arrangement similar to a stripe array is preferred to display data and/or character strings on a personal computer and the like. In contrast, a pixels' arrangement similar to a mosaic array is preferred to display a natural image on a video camera recorder, a digital still camera, or the like.

Returning back to FIG. 1, the signal processing unit 20 is an arithmetic operation circuit that controls operations of the image display panel 40 and the surface light source device 60 via the image display panel driving unit 30 and the surface light source device control unit 50. The signal processing unit 20 is coupled to the image display panel driving unit 30 and the surface light source device control unit 50.

The signal processing unit 20 processes an input signal input from an external application processor (a host CPU, not illustrated) to generate an image processing signal and a surface light source device control signal SBL. The signal processing unit 20 converts an input value of the input signal into an extended value (image processing signal) in the extended color space (for example, an HSV color space) extended with the first color, the second color, the third color, and the fourth color to be generated. The signal processing unit 20 then outputs the generated image processing signal to the image display panel driving unit 30. The signal processing unit 20 outputs the surface light source device control signal SBL, which is generated by the signal processing unit 20 itself, to the surface light source device control unit 50. In this embodiment, the extended color space is the HSV color space. However, the extended color space is not limited thereto, and may be an XYZ color space, a YUV space, and other coordinate systems.

Figure 4:
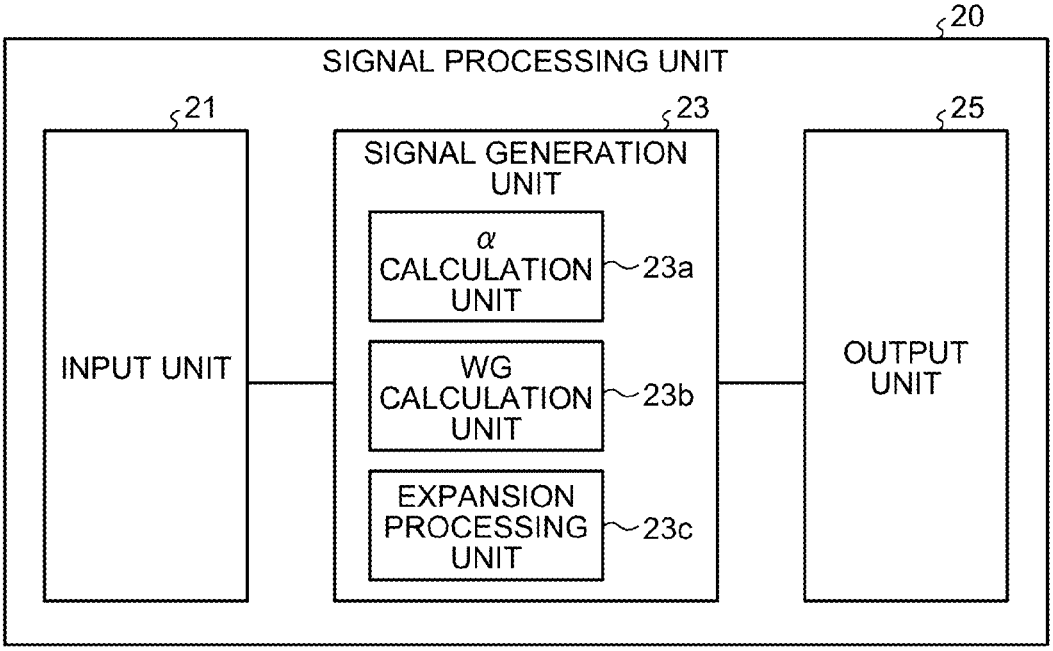
FIG. 4 is a schematic diagram illustrating an overview of a configuration of a signal processing unit according to the embodiment.

FIG. 4 is a schematic diagram illustrating an overview of a configuration of the signal processing unit according to the embodiment. As illustrated in FIG. 4, the signal processing unit 20 includes an input unit 21, a signal generation unit 23, and an output unit 25.

The input unit 21 receives the input signal from the external application processor. The input unit 21 may include, for example, an input signal compressing unit, a RAM, and an input signal expanding unit, compress data of the input signal to be temporarily stored in the RAM, and read out the data stored in the RAM to expand the data.

The signal generation unit 23 reads out the input signal input to the input unit 21 to generate the image processing signal. The signal generation unit 23 includes an $\alpha$ calculation unit 23*a*, a WG calculation unit 23*b*, and an expansion processing unit 23*c*. The $\alpha$ calculation unit 23*a* calculates an expansion coefficient $\alpha$. The $\alpha$ calculation unit 23*a* calculates $1/\alpha$. Calculation processing of the expansion coefficient $\alpha$ will be described later.

The WG calculation unit 23*b* calculates a fourth sub-pixel correction value WG, so-called white gain, using the expansion coefficient $\alpha$ calculated by the $\alpha$ calculation unit 23*a* and the input signal input to the input unit 21. Calculation processing of the fourth sub-pixel correction value WG will be described later.

The expansion processing unit 23*c* performs expansion processing on the input signal using the expansion coefficient $\alpha$ calculated by the $\alpha$ calculation unit 23*a*, the fourth sub-pixel correction value WG calculated by the WG calculation unit 23*b*, and the input signal input to the input unit 21. That is, the expansion processing unit 23*c* converts the input value of the input signal into the extended value (image processing signal) in the extended color space (for example, the HSV color space) to generate the image display signal. The expansion processing will be described later.

The output unit 25 outputs the image processing signal generated by the signal generation unit 23 to the image display panel driving unit 30.

Returning back to FIGS. 1 and 3, the image display panel driving unit 30 includes a signal output circuit 31 and a scanning circuit 32. In the image display panel driving unit 30, the signal output circuit 31 holds video signals to be sequentially output to the image display panel 40. More specifically, the signal output circuit 31 outputs an image output signal having a predetermined electric potential corresponding to the image processing signal to the image display panel 40. The signal output circuit 31 is electrically coupled to the image display panel 40 via a signal line DTL. The scanning circuit 32 controls ON/OFF of a switching element (for example, a TFT) for controlling an operation of the sub-pixel 49 (light transmittance) in the image display panel 40. The scanning circuit 32 is electrically coupled to the image display panel 40 via wiring SCL.

The surface light source device 60 is arranged on a back surface of the image display panel 40, and illuminates the image display panel 40 by emitting light thereto. The surface light source device 60 irradiates the entire surface of the image display panel 40 with light and makes the image display panel 40 brighter.

The surface light source device control unit 50 controls an amount and the like of the light output from the surface light source device 60. Specifically, the surface light source device control unit 50 adjusts a voltage and the like supplied to the surface light source device 60 based on the surface light source device control signal SBL output from the signal processing unit 20 using pulse width modulation (PWM) and the like to control the amount of light (light intensity) that irradiates the image display panel 40.

Operation of Signal Processing Unit

Figure 5:
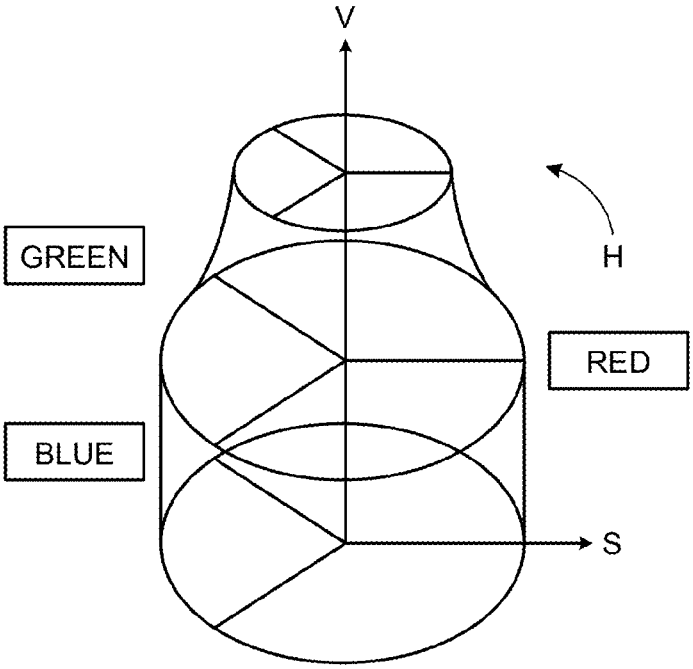
FIG. 5 is a conceptual diagram of an extended color space that can be extended by the display device according to the embodiment.
Figure 6:
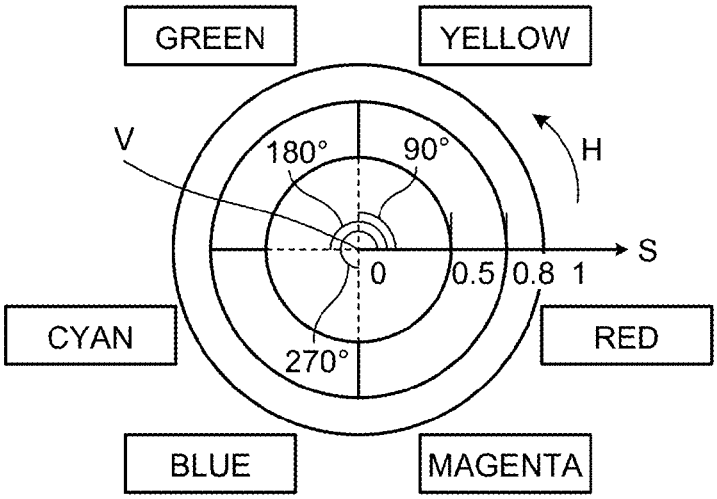
FIG. 6 is a conceptual diagram illustrating a relation between a hue and saturation in the extended color space.

Next, with reference to FIGS. 5 and 6, the following describes an operation performed by the signal processing unit 20. FIG. 5 is a conceptual diagram of the extended color space (for example, the HSV color space) that can be extended by the display device according to the embodiment. FIG. 6 is a conceptual diagram illustrating a relation between a hue and saturation in the extended color space (for example, the HSV color space).

The signal processing unit 20 receives the input signal, which is information of the image to be displayed, input from the external application processor. The input signal includes the information of the image (color) to be displayed at its position for each pixel as the input signal. Specifically, with respect to the (p, q)-th pixel (where $1 \le p \le I$, $1 \le q \le Q_0$), the signal processing unit 20 receives a signal input thereto including an input signal of the first sub-pixel 49R the signal value of which is $x_{1-(p,\ q)}$, an input signal of the second sub-pixel 49G the signal value of which is $x_{2-(p,\ q)}$, and an input signal of the third sub-pixel 49B the signal value of which is $x_{3-(p,\ q)}$.

The signal processing unit 20 processes the input signal to generate an output signal of the first sub-pixel as a signal for the first sub-pixel for determining the display gradation of the first sub-pixel 49R (signal value $X_{1-(p,\ q)}$), an output signal of the second sub-pixel as a signal for the second sub-pixel for determining the display gradation of the second sub-pixel 49G (signal value $X_{2-(p,\ q)}$), an output signal of the third sub-pixel as a signal for the third sub-pixel for determining the display gradation of the third sub-pixel 49B (signal value $X_{3-(p,\ q)}$), and an output signal of the fourth sub-pixel as a signal for the fourth sub-pixel for determining the display gradation of the fourth sub-pixel 49W (signal value $X_{4-(p,\ q)}$) to be output as image processing signals to the image display panel driving unit 30.

In the display device 10, the pixel 48 includes the fourth sub-pixel 49W for outputting the fourth color (white) to widen a dynamic range of brightness in the extended color space (for example, the HSV color space) as illustrated in FIG. 5. That is, as illustrated in FIG. 5, a substantially trapezoidal three-dimensional shape, in which the maximum value of brightness is reduced as the saturation increases and oblique sides of a cross-sectional shape including a saturation axis and a brightness axis are curved lines, is placed on a cylindrical color space that can be displayed by the first sub-pixel, the second sub-pixel, and the third sub-pixel. The signal processing unit 20 stores the maximum value Vmax (S) of the brightness using the saturation S as a variable in the extended color space (for example, the HSV color space) expanded by adding the fourth color (white). That is, the signal processing unit 20 stores the maximum value Vmax (S) of the brightness for respective coordinates (values) of the saturation and the hue regarding the three-dimensional shape of the color space (for example, the HSV color space) illustrated in FIG. 5. The input signals include the input signals of the first sub-pixel 49R, the second sub-pixel 49G, and the third sub-pixel 49B, so that the color space of the input signals has a cylindrical shape, that is, the same shape as a cylindrical part of the extended color space (for example, the HSV color space). It should be noted that the brightness in HSV color space is represented by a numerical value.

In the signal processing unit 20, the expansion processing unit 23*c* calculates the output signal (signal value $X_{1-(p,\ q)}$) of the first sub-pixel based on at least the input signal (signal value $x_{1-(p,\ q)}$) of the first sub-pixel and the expansion coefficient $\alpha$, calculates the output signal (signal value $X_{2-(p,\ q)}$) of the second sub-pixel based on at least the input signal (signal value $x_{2-(p,\ q)}$) of the second sub-pixel and the expansion coefficient $\alpha$, and calculates the output signal (signal value $X_{3-(p,\ q)}$) of the third sub-pixel based on at least the input signal (signal value $x_{3-(p,\ q)}$) of the third sub-pixel and the expansion coefficient $\alpha$.

Specifically, the output signal of the first sub-pixel is calculated based on the input signal of the first sub-pixel, the expansion coefficient $\alpha$, and the output signal of the fourth sub-pixel, the output signal of the second sub-pixel is calculated based on the input signal of the second sub-pixel, the expansion coefficient $\alpha$, and the output signal of the fourth sub-pixel, and the output signal of the third sub-pixel is calculated based on the input signal of the third sub-pixel, the expansion coefficient $\alpha$, and the output signal of the fourth sub-pixel.

That is, where $\chi$ is a constant depending on the display device 10, the signal processing unit 20 obtains, from the following expressions (1), (2), and (3), the output signal value $X_{1-(p,\ q)}$ of the first sub-pixel, the output signal value $X_{2-(p,\ q)}$ of the second sub-pixel, and the output signal value $X_{3-(p,\ q)}$ of the third sub-pixel, each of those signal values being output to the (p, q)-th pixel (or a group of the first sub-pixel 49R, the second sub-pixel 49G, and the third sub-pixel 49B).

$$X_{1-(p,q)}=\alpha\cdot x_{1-(p,q)}-\chi\cdot X_{4-(p,q)} \quad (1)$$

$$X_{2-(p,q)}=\alpha\cdot x_{2-(p,q)}-\chi\cdot X_{4-(p,q)} \quad (2)$$

$$X_{3-(p,q)}=\alpha\cdot x_{3-(p,q)}-\chi\cdot X_{4-(p,q)} \quad (3)$$

The signal processing unit 20 obtains the maximum value Vmax(S) of the brightness using the saturation S as a variable in the color space (for example, the HSV color space) expanded by adding the fourth color, and obtains the saturation S and the brightness V(S) in the pixels 48 based on the input signal values of the sub-pixels 49 in the pixels 48. In the signal processing unit 20, the α calculation unit 23*a* calculates the expansion coefficient α based on the maximum value Vmax(S) of the brightness and the brightness V(S).

The saturation S and the brightness V(S) are expressed as follows: S=(Max−Min)/Max, and V(S)=Max. The saturation S may take values of 0 to 1, the brightness V(S) may take values of 0 to $(2^n-1)$, and n is a display gradation bit number. Max is the maximum value among the input signal values of three sub-pixels, that is, the input signal value of the first sub-pixel 49R, the input signal value of the second sub-pixel 49G, and the input signal value of the third sub-pixel 49B, each of those signal values being input to the pixel 48. Min is the minimum value among the input signal values of three sub-pixels, that is, the input signal value of the first sub-pixel 49R, the input signal value of the second sub-pixel 49G, and the input signal value of the third sub-pixel 49B, each of those signal values being input to the pixel 48. A hue H is represented in a range of 0° to 360° as illustrated in FIG. 6. Arranged are red, yellow, green, cyan, blue, magenta, and red from 0° to 360°. In the embodiment, a region including an angle 0° is red, a region including an angle 120° is green, and a region including an angle 240° is blue.

In the signal processing unit 20, the WG calculation unit 23*b* calculates the fourth sub-pixel correction value WG based on the input signal (signal value $x_{1-(p,\ q)}$) of the first sub-pixel 49R, the input signal (signal value $x_{2-(p,\ q)}$) of the second sub-pixel 49G, the input signal (signal value $x_{3-(p,\ q)}$) of the third sub-pixel 49B, and the expansion coefficient α. More specifically, in the signal processing unit 20, the WG calculation unit 23*b* calculates the fourth sub-pixel correction value WG based on $Max_{(p,\ q)}$ (the maximum value among the input signal values of three sub-pixels, that is, the signal value $x_{1-(p,\ q)}$, the signal value $x_{2-(p,\ q)}$, and the signal value $x_{3-(p,\ q)}$, $Min_{(p,\ q)}$ (the minimum value among the input signal values of three sub-pixels, that is, the signal value $x_{1-(p,\ q)}$, the signal value $x_{2-(p,\ q)}$, and the signal value $x_{3-(p,\ q)}$, and the expansion coefficient α.

More specifically, in the signal processing unit 20, the WG calculation unit 23*b* calculates the fourth sub-pixel correction value WG so that the fourth sub-pixel correction value WG increases as the expansion coefficient α increases. In the signal processing unit 20, the WG calculation unit 23*b* calculates the fourth sub-pixel correction value WG so that the fourth sub-pixel correction value WG increases as a difference between $Max_{(p,\ q)}$ and $Min_{(p,\ q)}$ increases. Specifically, in the signal processing unit 20, the WG calculation unit 23*b* calculates the fourth sub-pixel correction value WG based on the following expressions (4) and (5).

$$WG=a\cdot(Max_{(p,q)}-1/\alpha)/Min_{(p,q)}+b \quad (4)$$

$$WG\geq 1.0 \quad (5)$$

The expression (5) means that the fourth sub-pixel correction value WG is 1 when the fourth sub-pixel correction value WG exceeds 1 in the expression (4). Although the fourth sub-pixel correction value WG is preferably set in a range of the expression (5), the fourth sub-pixel correction value WG may exceed the range when deterioration in display quality can be accepted. Here, a and b are coefficients set in a range of a≥1 and 0≤b≤1. Alternatively, they may be appropriately set in another range. The signal processing unit 20 stores values of a and b in a look-up table, for example. Note that the signal processing unit 20 can change the values of a and b through an operation by an operator, for example. In this embodiment, a is 1 and b is 0.

According to the embodiment, in the signal processing unit 20, the expansion processing unit 23*c* obtains the output signal value $X_{4-(p,\ q)}$ of the fourth sub-pixel 49W based on the input signal of the first sub-pixel 49R, the input signal of the second sub-pixel 49G, the input signal of the third sub-pixel 49B, the expansion coefficient α, and the fourth sub-pixel correction value WG. More specifically, the signal processing unit 20 obtains the signal value $X_{4-(p,\ q)}$ based on Min (the minimum value among the input signal values of three sub-pixels, that is, the input signal value of the first sub-pixel 49R, the input signal value of the second sub-pixel 49G, and the input signal value of the third sub-pixel 49B each of those signal values being input to the pixel), the expansion coefficient α, and the fourth sub-pixel correction value WG. Specifically, the signal processing unit 20 obtains the signal value $X_{4-(p,\ q)}$ based on the following expression (6). In the expression (6), a product of $Min_{(p,\ q)}$ and the expansion coefficient α is divided by χ, and multiplied by the fourth sub-pixel correction value WG. However, the embodiment is not limited thereto. χ will be described later.

$$X_{4-(p,q)}=Min_{(p,q)}\cdot(\alpha/\chi)\cdot WG \quad (6)$$

Generally, in the (p, q)-th pixel, the saturation $S_{(p,\ q)}$ and the brightness $V(S)_{(p,\ q)}$ in the cylindrical color space can be obtained from the following expressions (7) and (8) based on the input signal (signal value $x_{1-(p,\ q)}$ of the first sub-pixel 49R, the input signal (signal value $x_{2-(p,\ q)}$) of the second sub-pixel 49G, and the input signal (signal value $x_{3-(p,\ q)}$) of the third sub-pixel 49B.

$$S_{(p,q)}=(Max_{(p,q)}-Min_{(p,q)}/Max_{(p,q)} \quad (7)$$

$$V(S)_{(p,q)}=Max_{(p,q)} \quad (8)$$

In these equations, $Max_{(p,\ q)}$ is the maximum value among the input signal values of three sub-pixels 49, that is, ($x_{1-(p,\ q)}$, $x_{2-(p,\ q)}$, and $x_{3-(p,\ q)}$), and $Min_{(p,\ q)}$ is the minimum value of the input signal values of three sub-pixels 49, that is, ($x_{1-(p,\ q)}$, $x_{2-(p,\ q)}$, and $x_{3-(p,\ q)}$). In the embodiment, n is 8. That is, the display gradation bit number is 8 bits (a value of the display gradation is 256 gradations, that is, 0 to 255).

No color filter is arranged for the fourth sub-pixel 49W that displays white. The fourth sub-pixel 49W that displays the fourth color is brighter than the first sub-pixel 49R that displays the first color, the second sub-pixel 49G that displays the second color, and the third sub-pixel 49B that displays the third color when irradiated with the same lighting quantity of a light source. When a signal having a value corresponding to the maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, luminance of an aggregate of the first sub-pixel 49R, the second sub-pixel 49G, and the third sub-pixel 49B included in the pixel 48 or a group of pixels 48 is $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is $BN_4$. That is, white (maximum luminance) is displayed by the aggregate of the first sub-pixel 49R, the second sub-pixel 49G, and the third sub-pixel 49B, and the luminance of the white is represented by $BN_{1-3}$. Where $\chi$ is a constant depending on the display device 10, the constant $\chi$ is represented by $\chi=BN_4/BN_{1-3}$.

Specifically, the luminance $BN_4$ when the input signal having a value of display gradation 255 is assumed to be input to the fourth sub-pixel 49W is, for example, 1.5 times the luminance $BN_{1-3}$ of white where the input signals having values of display gradation such as the signal value $x_{1-(p,\ q)}=255$, the signal value $x_{2-(p,\ q)}=255$, and the signal value $x_{3-(p,\ q)}=255$, are input to the aggregate of the first sub-pixel 49R, the second sub-pixel 49G, and the third sub-pixel 49B. That is, in this embodiment, $\chi=1.5$.

When the signal value $X_{4-(p,\ q)}$ is represented by the expression (6) described above, Vmax(S) can be represented by the following expressions (9) and (10).

When $S \leq S_0$:

$$V\max(S)=(\chi+1)\cdot(2^n-1) \tag{9}$$

When $S_0<S\leq 1$:

$$V\max(S)=(2^n-1)\cdot(1/S) \tag{10}$$

In these equations, $S_0=1/(x+1)$ is satisfied.

The thus obtained maximum value Vmax(S) of the brightness using the saturation S as a variable in the extended color space (for example, the HSV color space) expanded by adding the fourth color is stored in the signal processing unit 20 as a kind of look-up table, for example. Alternatively, the signal processing unit 20 obtains the maximum value Vmax (S) of the brightness using the saturation S as a variable in the expanded color space (for example, the HSV color space) as occasion demands.

Next, the following describes a method of obtaining the signal values $X_{1-(p,\ q)}$, $X_{2-(p,\ q)}$, $X_{3-(p,\ q)}$, and $X_{4-(p,\ q)}$ as output signals of the (p, q)-th pixel 48 (expansion processing). The following processing is performed to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). The processing is performed to also keep (maintain) color tone. In addition, the processing is performed to keep (maintain) a gradation-luminance characteristic (gamma characteristic, $\gamma$ characteristic). When all of the input signal values are 0 or small values in any one of the pixels 48 or a group of the pixels 48, the expansion coefficient $\alpha$ may be obtained without including such a pixel 48 or a group of pixels 48.

First Process

First, the signal processing unit 20 obtains the saturation S and the brightness V(S) in the pixels 48 based on the input signal values of the sub-pixels 49 of the pixels 48. Specifically, $S_{(p,\ q)}$ and $V(S)_{(p,\ q)}$ are obtained from the expressions (7) and (8) based on the signal value $x_{1-(p,\ q)}$ that is the input signal of the first sub-pixel 49R, the signal value $x_{2-(p,\ q)}$ that is the input signal of the second sub-pixel 49G, and the signal value $x_{3-(p,\ q)}$ that is the input signal of the third sub-pixel 49B, each of those signal values being input to the (p, q)-th pixel 48. The signal processing unit 20 performs this processing on all of the pixels 48.

Second Process

Next, the signal processing unit 20 obtains the expansion coefficient $\alpha(S)$ based on the Vmax(S)/V(S) obtained in the pixels 48.

$$\alpha(S)=V\max(S)/V(S) \tag{11}$$

Third Process

Next, the signal processing unit 20 obtains the fourth sub-pixel correction value WG based on the signal value $x_{1-(p,\ q)}$, the signal value $x_{2-(p,\ q)}$, the signal value $x_{3-(p,\ q)}$, and the expansion coefficient $\alpha(S)$. Specifically, the signal processing unit 20 obtains the fourth sub-pixel correction value WG through the expressions (4) and (5) based on $Max_{(p,\ q)}$, $Min_{(p,\ q)}$, and the expansion coefficient $\alpha(S)$ so that the fourth sub-pixel correction value WG increases as the expansion coefficient $\alpha$ increases, and the fourth sub-pixel correction value WG increases as the difference between $Max_{(p,\ q)}$ and $Min_{(p,\ q)}$ increases. The signal processing unit 20 obtains the fourth sub-pixel correction value WG for all of the $P_0 \times Q_0$ pixels 48.

Fourth Process

Next, the signal processing unit 20 obtains the signal value $X_{4-(p,\ q)}$ in the (p, q)-th pixel 48 based on at least the signal value $x_{1-(p,\ q)}$, the signal value $x_{2-(p,\ q)}$, and the signal value $x_{3-(p,\ q)}$. In the embodiment, the signal processing unit 20 determines the signal value $X_{4-(p,\ q)}$ based on $Min_{(p,\ q)}$, the expansion coefficient $\alpha$, the constant $\chi$, and the fourth sub-pixel correction value WG. More specifically, as described above, the signal processing unit 20 obtains the signal value $X_{4-(p,\ q)}$ based on the expression (6). The signal processing unit 20 obtains the signal value $X_{4-(p,\ q)}$ for all of the $P_0 \times Q_0$ pixels 48.

Fifth Process

Subsequently, the signal processing unit 20 obtains the signal value $X_{1-(p,\ q)}$ in the (p, q)-th pixel 48 based on the signal value $x_{1-(p,\ q)}$, the expansion coefficient $\alpha$, and the signal value $X_{4-(p,\ q)}$, obtains the signal value $X_{2-(p,\ q)}$ in the (p, q)-th pixel 48 based on the signal value $x_{2-(p,\ q)}$, the expansion coefficient $\alpha$, and the signal value $X_{4-(p,\ q)}$, and obtains the signal value $X_{3-(p,\ q)}$ in the (p, q)-th pixel 48 based on the signal value $x_{3-(p,\ q)}$, the expansion coefficient $\alpha$, and the signal value $X_{4-(p,\ q)}$. Specifically, the signal processing unit 20 obtains the signal value $X_{1-(p,\ q)}$, the signal value $X_{2-(p,\ q)}$, and the signal value $X_{3-(p,\ q)}$ in the (p, q)-th pixel 48 based on the expressions (1) to (3) described above.

The signal processing unit 20 expands the value of $Min_{(p,\ q)}$ with the expansion coefficient $\alpha$ as represented by the expression (6). In this way, when the value of $Min_{(p,\ q)}$ is expanded with the expansion coefficient $\alpha$, not only the luminance of the white display sub-pixel (fourth sub-pixel 49W) but also the luminance of the red display sub-pixel, the green display sub-pixel, and the blue display sub-pixel (corresponding to the first sub-pixel 49R, the second sub-pixel 49G, and the third sub-pixel 49B, respectively) is increased. Due to this, dullness of color can be prevented. That is, when the value of $Min_{(p, q)}$ is expanded with the expansion coefficient α, the luminance of the entire image is multiplied by α as compared with a case in which the value of $Min_{(p, q)}$ is not expanded. Accordingly, for example, a static image and the like can be preferably displayed with high luminance.

In the display device 10 according to the embodiment, the signal value $X_{1-(p, q)}$, the signal value $X_{2-(p, q)}$, and the signal value $X_{3-(p, q)}$ in the (p, q)-th pixel are expanded by α times. Accordingly, the display device 10 may reduce the luminance of the surface light source device 60 based on the expansion coefficient α so as to cause the luminance to be the same as that of the image that is not expanded. Specifically, the luminance of the surface light source device 60 may be multiplied by $(1/\alpha_A)$. Accordingly, power consumption of the surface light source device 60 can be reduced. The signal processing unit 20 outputs this (1/α) as the surface light source device control signal SBL to the surface light source device control unit 50 (refer to FIG. 1).

Fourth Sub-Pixel Correction Value WG

Next, the following describes the fourth sub-pixel correction value WG. As described above, the fourth sub-pixel correction value WG is represented by the expression (4) where a is 1 and b is 0, so that the fourth sub-pixel correction value WG is represented by the expression (5) and the following expression (12).

$$WG=(Max_{(p,q)})-1/\alpha)/Min_{(p,q)} \quad (12)$$

Figure 7:
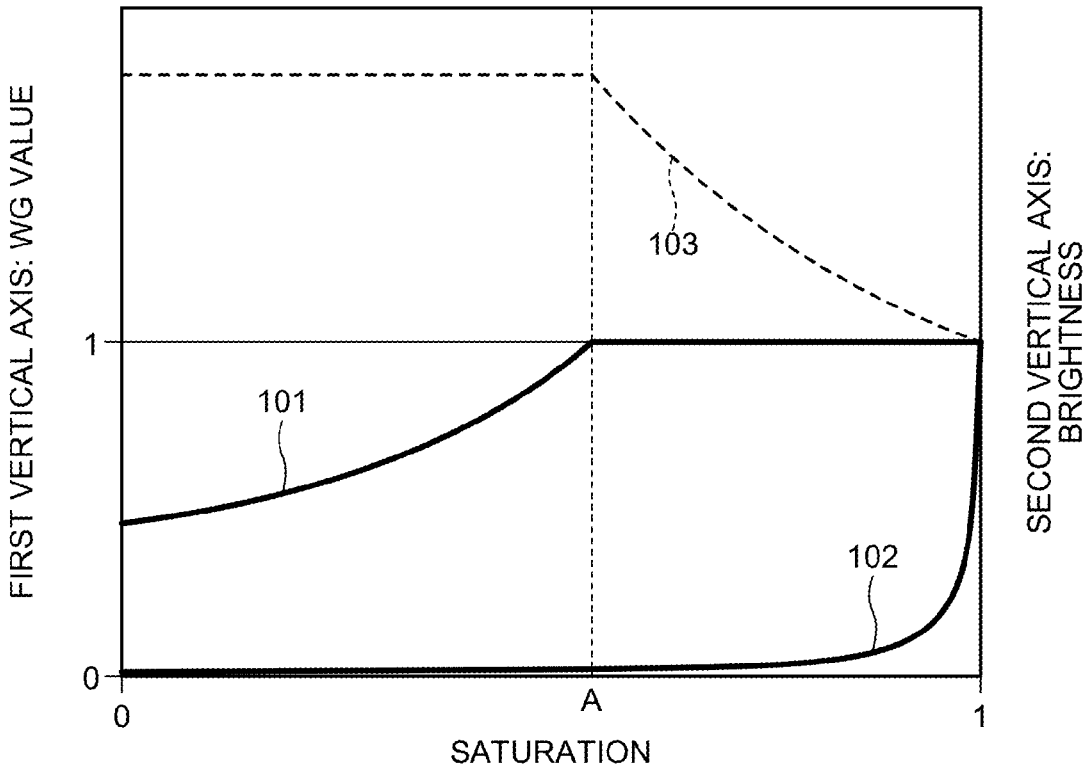
FIG. 7 is a graph illustrating a fourth sub-pixel correction value WG corresponding to the saturation.

FIG. 7 is a graph illustrating the fourth sub-pixel correction value WG corresponding to the saturation. The horizontal axis in FIG. 7 indicates the saturation $S_{(p, q)}$ represented by the expression (7). The vertical axis in FIG. 7 indicates the fourth sub-pixel correction value WG as a first vertical axis and the brightness $V(S)_{(p, q)}$ represented by the expression (8) as a second vertical axis. A line segment 101 indicates the fourth sub-pixel correction value WG when the horizontal axis is taken as the saturation $S_{(p, q)}$ and the vertical axis is taken as the fourth sub-pixel correction value WG where the expansion coefficient α is (1+χ). As described above, χ=1.5 in this embodiment, so that the line segment 101 indicates the fourth sub-pixel correction value WG where the expansion coefficient α is 2.5. A line segment 102 indicates the fourth sub-pixel correction value WG when the horizontal axis is taken as the saturation $S_{(p, q)}$ and the vertical axis is taken as the fourth sub-pixel correction value WG where the expansion coefficient α is 1.01. A line segment 103 indicates the maximum value Vmax(S) of the brightness using the saturation S as a variable in the color space (for example, the HSV color space) expanded by adding the fourth color when the horizontal axis is taken as the saturation $S_{(p, q)}$ and the vertical axis is taken as the brightness $V(S)_{(p, q)}$.

The fourth sub-pixel correction value WG increases as the difference between $Max_{(p, q)}$ and $Min_{(p, q)}$ increases. Accordingly, as indicated by the line segments 101 and 102 in FIG. 7, the fourth sub-pixel correction value WG increases as the saturation $S_{(p, q)}$ increases when the expansion coefficient α is constant. The fourth sub-pixel correction value WG is preferably equal to or smaller than 1. Accordingly, regarding the line segment 101, the fourth sub-pixel correction value WG increases as the saturation $S_{(p, q)}$ increases, and become constant when reaching 1.

The fourth sub-pixel correction value WG varies depending on a value of the expansion coefficient α. The fourth sub-pixel correction value WG becomes a value indicated by the line segment 101 when the expansion coefficient α is 2.5, and becomes a value indicated by the line segment 102 when the expansion coefficient α is 1.01. The fourth sub-pixel correction value WG increases as the expansion coefficient α increases. As illustrated in FIG. 7, the fourth sub-pixel correction value WG indicated by the line segment 101 in which α=2.5 is larger than that indicated by the line segment 102 in which α=1.01.

As indicated by the line segment 103, the maximum value Vmax(S) of the brightness decreases as the saturation $S_{(p, q)}$ increases.

Comparing the line segments 101 and 102 with the line segment 103, the maximum value Vmax(S) of the brightness decreases as the saturation $S_{(p, q)}$ increases, and in contrast, the fourth sub-pixel correction value WG increases as the saturation $S_{(p, q)}$ increases.

Evaluation Result 1

Next, the following describes an evaluation result 1 of the output signal value of each sub-pixel after the expansion processing is performed by the display device 10 according to the embodiment and display devices according to comparative examples 1 and 2.

The display device according to the comparative example 1 obtains an output signal value $Y_{4-(p, q)}$ of the fourth sub-pixel by the following expression (13).

$$Y_{4-(p,q)}=Min_{(p,q)}\cdot(\alpha/\chi) \quad (13)$$

That is, the display device according to the comparative example 1 obtains the output signal value $Y_{4-(p, q)}$ of the fourth sub-pixel without using the fourth sub-pixel correction value WG. The display device according to the comparative example 1 replaces the input signals of the first to the third sub-pixels with the output signal value $Y_{4-(p, q)}$ of the fourth sub-pixel as maximum as possible. In the display device according to the comparative example 1, a method of calculating the output signals of the first to the third sub-pixels and the expansion coefficient α is the same as that in the display device 10 according to the embodiment.

The display device according to the comparative example 2 obtains an output signal value $Z_{4-(p, q)}$ of the fourth sub-pixel through the following expressions (14) to (19).

$$A_{(p,q)}=\alpha\cdot x_{1-(p,q)}-(2^n-1) \quad (14)$$

$$B_{(p,q)}=\alpha\cdot x_{2-(p,q)}-(2^n-1) \quad (15)$$

$$C_{(p,q)}=\alpha\cdot x_{3-(p,q)}=(2^n-1) \quad (16)$$

$$S_{(p,q)}=\max(A_{(p,q)},B_{(p,q)},C_{(p,q)} \quad (17)$$

$$T_{(p,q)}=Min_{(p,q)}\cdot\alpha \quad (18)$$

$$Z_{(p,q)}=\min(S_{(p,q)},T_{(p,q)}/\chi \quad (19)$$

When each value of $A_{(p, q)}$, $B_{(p, q)}$, $C_{(p, q)}$, and $S_{(p, q)}$ is negative, 0 (zero) is substituted for the negative value in calculating $S_{(p, q)}$ and $Z_{(p, q)}$. The display device according to the comparative example 2 calculates, through the expressions (14) to (16), $A_{(p, q)}$, $B_{(p, q)}$, and $C_{(p, q)}$ that are values obtained by subtracting $(2^n-1)$, that is, possible maximum output values of the first to the third sub-pixels from the input signal values of the first to the third sub-pixels expanded with the expansion coefficient α. The display device according to the comparative example 2 then obtains a smaller value among the maximum values of $A_{(p, q)}$, $B_{(p, q)}$, and $C_{(p, q)}$ and $T_{(p, q)}$ calculated by the expression (18) as the output signal value $Z_{4-(p, q)}$ of the fourth sub-pixel.

That is, the display device according to the comparative example 2 replaces the expanded input signals of the first to the third sub-pixels with the output signals of the first to the third sub-pixels as maximum as possible to minimize the replacement of the fourth sub-pixel with the output signal value $Z_{4-(p,\ q)}$. In the display device according to the comparative example 2, a method of calculating the output signals of the first to the third sub-pixels and the expansion coefficient α is the same as that in the display device 10 according to the embodiment.

Figure 8A:
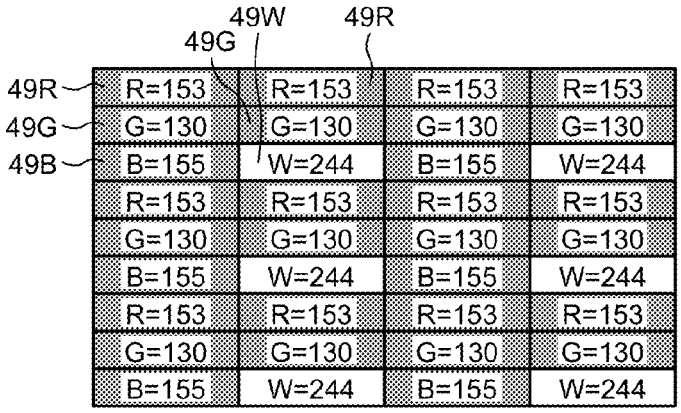
FIG. 8A is a schematic diagram in a case in which each of output signal values of first to fourth sub-pixels is output to each sub-pixel when an image M is expanded according to a comparative example 1.
Figure 8B:
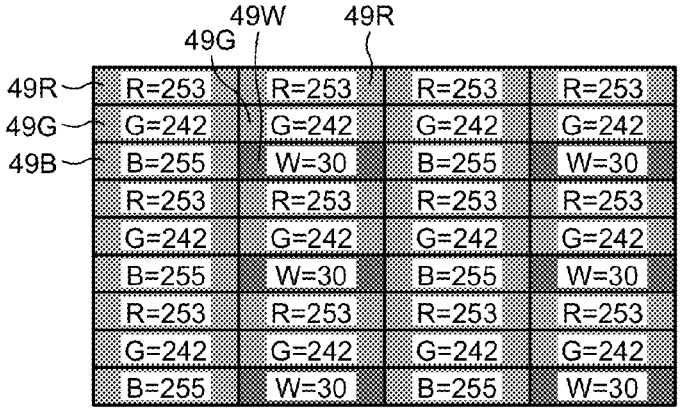
FIG. 8B is a schematic diagram in a case in which each of the output signal values of the first to the fourth sub-pixels is output to each sub-pixel when the image M is expanded according to a comparative example 2.
Figure 8C:
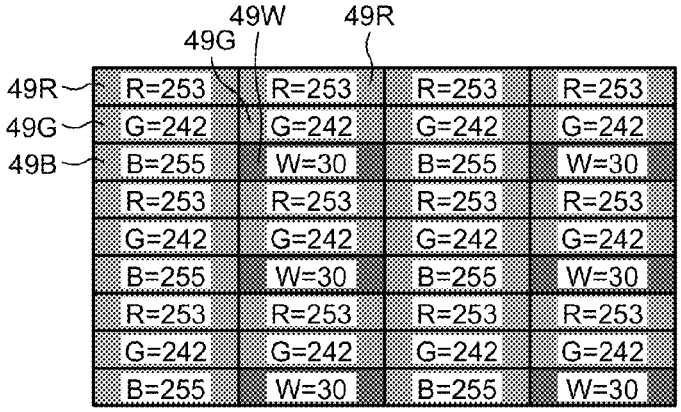
FIG. 8C is a schematic diagram in a case in which each of the output signal values of the first to the fourth sub-pixels is output to each sub-pixel when the image M is expanded according to the embodiment.

The evaluation result 1 compares cases in which expansion processing is performed on the image M the expansion coefficient α of which is small. FIG. 8A is a schematic diagram in a case in which each of the output signal values of the first to the fourth sub-pixels is output to each sub-pixel when the image M is expanded according to the comparative example 1. FIG. 8B is a schematic diagram in a case in which each of the output signal values of the first to the fourth sub-pixels is output to each sub-pixel when the image M is expanded according to the comparative example 2. FIG. 8C is a schematic diagram in a case in which each of the output signal values of the first to the fourth sub-pixels is output to each sub-pixel when the image M is expanded according to the embodiment. The image M is an image the entire brightness and saturation of which are high, and the expansion coefficient α thereof calculated in the comparative examples 1 and 2 and the embodiment is 1. That is, regarding the image M, the luminance of the input signal is not increased in the output signal. FIGS. 8A to 8C illustrate cases in which the image M is differently expanded according to the comparative example 1, the comparative example 2, and this embodiment, and part of the input signals is converted into the output signal of the fourth sub-pixel to be displayed.

In FIG. 8A, the first sub-pixel 49R contains R=153, the second sub-pixel 49G contains G=130, the third sub-pixel 49B contains B=155, and the fourth sub-pixel 49W contains W=244. That is, in FIG. 8A, the output signal value of the first sub-pixel 49R is 153, the output signal value of the second sub-pixel 49G is 130, the output signal value of the third sub-pixel 49B is 155, and the output signal value of the fourth sub-pixel 49W is 244. The same applies to FIGS. 8B and 8C.

As illustrated in FIG. 8A, when the expansion processing according to the comparative example 1 is performed on the image M, the output signal value of the first sub-pixel 49R is 153, the output signal value of the second sub-pixel 49G is 130, the output signal value of the third sub-pixel 49B is 155, and the output signal value of the fourth sub-pixel 49W is 244. In the comparative example 1, the input signals are replaced with the output signal of the fourth sub-pixel as much as possible, so that the output signal value of the fourth sub-pixel is larger than that of other sub-pixels. The luminance of the fourth sub-pixel 49W is larger than the luminance of the first to the third sub-pixels. Especially, the luminance of the third sub-pixel 49B is smaller than the luminance of the other sub-pixels. Accordingly, when the image M the expansion coefficient α of which is 1 is expanded according to the comparative example 1, a difference between the luminance of the fourth sub-pixel 49W and the luminance of the other sub-pixels is large, so that a boundary between the fourth sub-pixel 49W and the other sub-pixels adjacent thereto may be visually recognized. Especially, when the image M is expanded according to the comparative example 1, the boundary between the fourth sub-pixel 49W and the adjacent third sub-pixel 49B may be visually recognized more remarkably.

On the other hand, as illustrated in FIG. 8B, when the expansion processing according to the comparative example 2 is performed on the image M, the output signal value of the first sub-pixel 49R is 253, the output signal value of the second sub-pixel 49G is 242, the output signal value of the third sub-pixel 49B is 255, and the output signal value of the fourth sub-pixel 49W is 30. In the comparative example 2, the output values of the first to the third sub-pixels are made as large as possible, so that the output signal values of the first to the third sub-pixels are large and the output signal value of the fourth sub-pixel 49W is small. Accordingly, when the image M the expansion coefficient α of which is 1 is expanded according to the comparative example 2, the difference between the luminance of the fourth sub-pixel 49W and the luminance of the other sub-pixels is smaller than that in the comparative example 1, so that the boundary between the fourth sub-pixel 49W and the other sub-pixels adjacent thereto can be prevented from being visually recognized.

As illustrated in FIG. 8C, when the expansion processing according to this embodiment is performed on the image M, the output signal value of the first sub-pixel 49R is 253, the output signal value of the second sub-pixel 49G is 242, the output signal value of the third sub-pixel 49B is 255, and the output signal value of the fourth sub-pixel 49W is 30. In this embodiment, the fourth sub-pixel correction value WG is decreased as the expansion coefficient α decreases. Due to this, when the expansion processing according to the embodiment is performed on the image M the expansion coefficient α of which is small, the output value of the fourth sub-pixel decreases and the output values of the first to the third sub-pixels increase. Accordingly, when the image M the expansion coefficient α of which is 1 is expanded according to the embodiment, the difference between the luminance of the fourth sub-pixel 49W and the luminance of the other sub-pixels is smaller than that in the comparative example 1, so that the boundary between the fourth sub-pixel 49W and the other sub-pixels adjacent thereto can be prevented from being visually recognized.

In this way, regarding the image M the expansion coefficient α is 1, as in the expansion processing according to the comparative example 2 and the embodiment, the output value of the fourth sub-pixel is made small and the output values of the first to the third sub-pixels are made large to prevent the boundary between the fourth sub-pixel 49W and the other sub-pixels adjacent thereto from being visually recognized and prevent deterioration in the display quality. Each result of the expansion processing according to the comparative examples 1 and 2 and the embodiment becomes the same as the evaluation result 1 so long as the expansion coefficient α of the image is small, not limited to the image M.

Evaluation Result 2

Figure 9A:
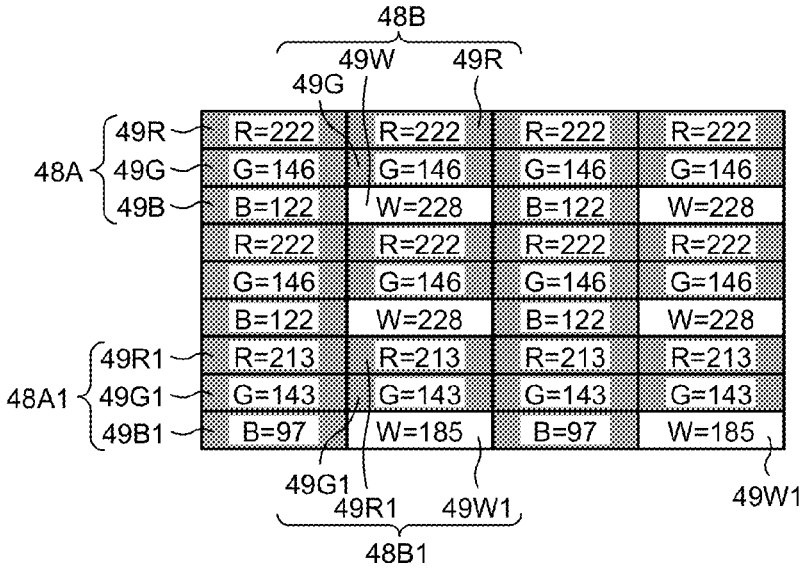
FIG. 9A is a schematic diagram in a case in which each of the output signal values of the first to the fourth sub-pixels is output to each sub-pixel when an image N is expanded according to the comparative example 1.
Figure 9B:
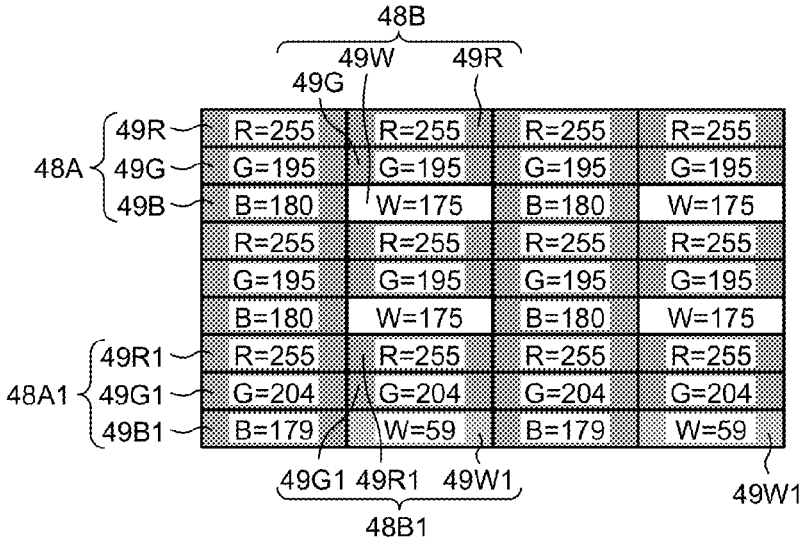
FIG. 9B is a schematic diagram in a case in which each of the output signal values of the first to the fourth sub-pixels is output to each sub-pixel when the image N is expanded according to the comparative example 2.
Figure 9C:
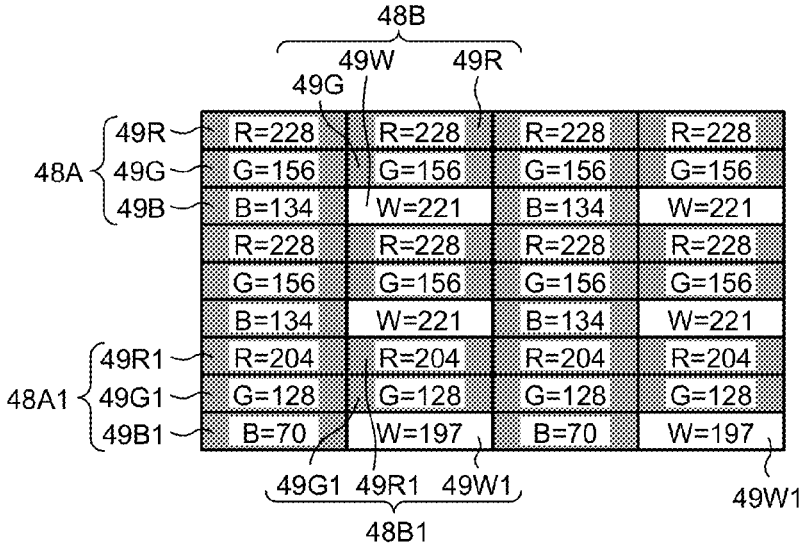
FIG. 9C is a schematic diagram in a case in which each of the output signal values of the first to the fourth sub-pixels is output to each sub-pixel when the image N is expanded according to the embodiment.

Next, the following describes an evaluation result 2 comparing cases of performing expansion processing on an image N in which the expansion coefficient α is large and the luminance is locally high. FIG. 9A is a schematic diagram in a case in which each of the output signal values of the first to the fourth sub-pixels is output to each sub-pixel when the image N is expanded according to the comparative example 1. FIG. 9B is a schematic diagram in a case in which each of the output signal values of the first to the fourth sub-pixels is output to each sub-pixel when the image N is expanded according to the comparative example 2. FIG. 9C is a schematic diagram in a case in which each of the output signal values of the first to the fourth sub-pixels is output to each sub-pixel when the image N is expanded according to the embodiment. The image N is an image the entire brightness and saturation of which are low, and the expansion coefficient α thereof calculated in the comparative examples 1 and 2 and the embodiment is 1.85. FIGS. 9A to 9C illustrate cases in which the image N is differently expanded according to the comparative example 1, the comparative example 2, and this embodiment, and part of the input signals is converted into the output signal of the fourth sub-pixel to be displayed.

First, the following describes the comparative example 2 illustrated in FIG. 9B. In FIG. 9B, the first sub-pixel 49R contains R=255, the second sub-pixel 49G contains G=195, the third sub-pixel 49B contains B=180, and the fourth sub-pixel 49W contains W=175. That is, in FIG. 9B, the output signal value of the first sub-pixel 49R is 255, the output signal value of the second sub-pixel 49G is 195, the output signal value of the third sub-pixel 49B is 180, and the output signal value of the fourth sub-pixel 49W is 175. The same applies to FIGS. 9A and 9C. A first sub-pixel 49R1 as part of the first sub-pixel 49R contains R=255. A second sub-pixel 49G1 as part of the second sub-pixel 49G contains G=204. A fourth sub-pixel 49B1 as part of the third sub-pixel 49B contains B=179. A fourth sub-pixel 49W1 as part of the fourth sub-pixel 49W contains W=59. A pixel 48A1 including the first sub-pixel 49R1, the second sub-pixel 49G1, and the third sub-pixel 49B1 is different from the pixel 48A in output values of the sub-pixels. A pixel 48B1 including the first sub-pixel 49R1, the second sub-pixel 49G1, and the fourth sub-pixel 49W1 is different from the pixel 48B in output values of the sub-pixels. The luminance of the pixel 48B is locally high.

As illustrated in FIG. 9B, when the expansion processing according to the comparative example 2 is performed on the image N, the output signal value of the first sub-pixel 49R is 255, the output signal value of the second sub-pixel 49G is 195, the output signal value of the third sub-pixel 49B is 180, and the output signal value of the fourth sub-pixel 49W is 175. The output signal value of the first sub-pixel 49R1 is 255, the output signal value of the second sub-pixel 49G1 is 204, the output signal value of the third sub-pixel 49B1 is 179, and the output signal value of the fourth sub-pixel 49W1 is 59. In the comparative example 2, the output values of the first to the third sub-pixels are made as large as possible, so that the output signal values of the first to the third sub-pixels are large and the output signal value of the fourth sub-pixel 49W is small. However, the expansion coefficient α of the image N is as high as 1.85, so that the luminance of the entire image is increased. The output signal value of the fourth sub-pixel 49W with respect to the image N is larger than the output signal value of the fourth sub-pixel 49W with respect to the image M in the evaluation result 1 because the luminance of the entire image is increased.

The luminance of the pixel 48B is locally high, and the luminance of the pixel 48B1 is relatively low. Accordingly, the output signal value of the fourth sub-pixel 49W of the image N is larger than the output signal value of the fourth sub-pixel 49W1 of the image N. That is, when the expansion processing according to the comparative example 2 is performed on the image N, the luminance of the fourth sub-pixel becomes nonuniform in the entire image. Accordingly, when the image N the expansion coefficient α of which is high is expanded according to the comparative example 2, the difference between the luminance of the fourth sub-pixel 49W and the luminance of the first to the third sub-pixels and the fourth sub-pixel 49W1 is large, so that the boundary between the fourth sub-pixel 49W and the other sub-pixels adjacent thereto may be visually recognized.

On the other hand, as illustrated in FIG. 9A, when the expansion processing according to the comparative example 1 is performed on the image N, the output signal value of the first sub-pixel 49R is 222, the output signal value of the second sub-pixel 49G is 146, the output signal value of the third sub-pixel 49B is 122, and the output signal value of the fourth sub-pixel 49W is 228. The output signal value of the first sub-pixel 49R1 is 213, the output signal value of the second sub-pixel 49G1 is 143, the output signal value of the third sub-pixel 49B1 is 97, and the output signal value of the fourth sub-pixel 49W1 is 185. In the comparative example 1, the input signals are replaced with the output signal of the fourth sub-pixel as much as possible, so that the output signal value of the fourth sub-pixel 49W1 is larger than that in the comparative example 2. Accordingly, a difference between the output signal value of the fourth sub-pixel 49W and the output signal value of the fourth sub-pixel 49W1 is smaller than that in the comparative example 2. That is, when the expansion processing according to the comparative example 1 is performed on the image N, the luminance of the fourth sub-pixel is more uniformized in the entire image. Accordingly, when the image N the expansion coefficient α of which is high is expanded according to the comparative example 1, a difference between the luminance of the fourth sub-pixel 49W and the luminance of the fourth sub-pixel 49W1 is small, so that the boundary between the fourth sub-pixel 49W and the other sub-pixels adjacent thereto is prevented from being visually recognized.

As illustrated in FIG. 9C, when the expansion processing according to the embodiment is performed on the image N, the output signal value of the first sub-pixel 49R is 228, the output signal value of the second sub-pixel 49G is 156, the output signal value of the third sub-pixel 49B is 134, and the output signal value of the fourth sub-pixel 49W is 221. The output signal value of the first sub-pixel 49R1 is 204, the output signal value of the second sub-pixel 49G1 is 128, the output signal value of the third sub-pixel 49B1 is 70, and the output signal value of the fourth sub-pixel 49W1 is 197. In this embodiment, the fourth sub-pixel correction value WG is increased as the expansion coefficient α increases. Due to this, when the expansion processing according to the embodiment is performed on the image N the expansion coefficient α of which is large, the output value of the fourth sub-pixel 49W1 is made larger than that in the comparative example 2 and the output values of the first to the third sub-pixels are made small. Accordingly, the difference between the output signal value of the fourth sub-pixel 49W and the output signal value of the fourth sub-pixel 49W1 is smaller than that in the comparative example 2. That is, when the expansion processing according to the embodiment is performed on the image N, the luminance of the fourth sub-pixel is more uniformized in the entire image. Accordingly, when the image N the expansion coefficient α of which is high is expanded according to the embodiment, the difference between the luminance of the fourth sub-pixel 49W and the luminance of the fourth sub-pixel 49W1 is small, so that the boundary between the fourth sub-pixel 49W and the other sub-pixels adjacent thereto is prevented from being visually recognized.

In this way, regarding the image N the expansion coefficient α is 1.85, as in the expansion processing according to the comparative example 1 and the embodiment, the output value of the fourth sub-pixel is made large to prevent the boundary between the fourth sub-pixel 49W and the other sub-pixels adjacent thereto from being visually recognized and prevent deterioration in the display quality. Each result of the expansion processing according to the comparative examples 1 and 2 and the embodiment becomes the same as the evaluation result 2 so long as the expansion coefficient $\alpha$ of the image is large and the luminance thereof is locally high, not limited to the image N.

In summary, although the expansion processing according to the comparative example 1 that gives priority to conversion of the fourth sub-pixel into the output signal can prevent the deterioration in the display quality of the image whose expansion coefficient $\alpha$ is large and whose luminance is locally high, the expansion processing cannot prevent the deterioration in the display quality of the image whose expansion coefficient $\alpha$ is small. In contrast, although the expansion processing according to the comparative example 2 that gives priority to the output signals of the first to the third sub-pixels can prevent the deterioration in the display quality of the image whose expansion coefficient $\alpha$ is small, the expansion processing cannot prevent the deterioration in the display quality of the image whose expansion coefficient $\alpha$ is large and whose luminance is locally high. On the other hand, the expansion processing according to the embodiment can prevent the deterioration in the display quality of both the image whose expansion coefficient $\alpha$ is small and the image whose expansion coefficient $\alpha$ is large and whose luminance is locally high.

In this way, the display device 10 according to the embodiment calculates the fourth sub-pixel correction value WG using the input signals of the first to the third sub-pixels and the expansion coefficient $\alpha$. Accordingly, the display device 10 according to the embodiment prevents the boundary between the fourth sub-pixel 49W and the other sub-pixels adjacent thereto from being visually recognized, so that the deterioration in the display quality can be prevented. More specifically, in the display device 10 according to the embodiment, the fourth sub-pixel correction value WG is increased as the expansion coefficient $\alpha$ increases. Accordingly, the display device 10 according to the embodiment can prevent the deterioration in the display quality of both the image whose expansion coefficient $\alpha$ is small and the image whose expansion coefficient $\alpha$ is large and whose luminance is locally high.

The output signal value of the fourth sub-pixel decreases as $\mathrm{Min}_{(p,\ q)}$ (the minimum value of the input signals of the first to the third sub-pixels) decreases. Due to this, generally, the output signal value of the fourth sub-pixel tends to be decreased as a difference between $\mathrm{Max}_{(p,\ q)}$ (the maximum value of the input signals of the first to the third sub-pixels) and $\mathrm{Min}_{(p,\ q)}$ increases, that is, as the saturation increases. However, the display device 10 according to the embodiment determines the fourth sub-pixel correction value WG so that the fourth sub-pixel correction value WG increases as the difference between $\mathrm{Max}_{(p,\ q)}$ and $\mathrm{Min}_{(p,\ q)}$ increases. Accordingly, the display device 10 according to the embodiment can prevent the output signal value of the fourth sub-pixel from becoming too small as the difference between $\mathrm{Max}_{(p,\ q)}$ and $\mathrm{Min}_{(p,\ q)}$ increases, and appropriately perform the expansion processing.

To perform optimum expansion processing, the fourth sub-pixel correction value WG increases as the saturation increases, and when the fourth sub-pixel correction value WG reaches 1, the fourth sub-pixel correction value WG is fixed to 1 as a constant value even though the saturation further increases. When the display quality is permissible, the fourth sub-pixel correction value WG is not necessarily constant and may be a value in a permissible range.

The display device 10 according to the embodiment calculates the fourth sub-pixel correction value WG using the expressions (4) and (5). Accordingly, the display device 10 according to the embodiment can preferably prevent the deterioration in the display quality. The expression is not limited to the expression (4) so long as the display device 10 according to the embodiment calculates the fourth sub-pixel correction value WG so that the fourth sub-pixel correction value WG increases as the expansion coefficient $\alpha$ increases, and the fourth sub-pixel correction value WG increases as the difference between $\mathrm{Max}_{(p,\ q)}$ and $\mathrm{Min}_{(p,\ q)}$ increases. The display device 10 according to the embodiment may calculate, as the fourth sub-pixel correction value, a fourth sub-pixel correction value WG1 using the following expressions (20) and (21), for example, calculate a fourth sub-pixel correction value WG2 using the following expressions (22) and (23), calculate a fourth sub-pixel correction value WG3 using the following expressions (24) and (25), or calculate a fourth sub-pixel correction value WG4 using the following expressions (26) and (27).

$$WG1=a\cdot(\mathrm{Max}-\mathrm{Min})+(1-1/\alpha)+b \tag{20}$$

$$WG1\leq 1.0 \tag{21}$$

$$WG2=a\cdot\{(\mathrm{Max}-\mathrm{Min})+(1-1/\alpha)\} \tag{22}$$

$$WG2\leq 1.0 \tag{23}$$

$$WG3=a\cdot\alpha^{C}\cdot(\mathrm{Max}-\mathrm{Min})^{d}+(1-1/\alpha)+b \tag{24}$$

$$WG3\leq 1.0 \tag{25}$$

$$WG4=\max(WG, WG1, WG2, WG3) \tag{26}$$

$$WG4\leq 1.0 \tag{27}$$

In these equations, a, b, c, and d are coefficients, and $a\geq 1$, $0\leq b\leq 1$, $c\geq 0$, and $d>0$ are preferably satisfied. However, the embodiment is not limited thereto.

In the display device 10 according to the embodiment, the pixel 48A including the first sub-pixel 49R, the second sub-pixel 49G, and the third sub-pixel 49B and the pixel 48B including the first sub-pixel 49R, the second sub-pixel 49G, and the fourth sub-pixel 49W are alternately arranged. In such an arrangement, a blue third sub-pixel 49B the luminance of which is small and the fourth sub-pixel 49W the luminance of which is large are alternately arranged. Due to this, in such an arrangement, a boundary between the fourth sub-pixel 49W and the third sub-pixel 49B adjacent thereto may be visually recognized more remarkably. However, the display device 10 according to the embodiment calculates the fourth sub-pixel correction value WG based on the input signals of the first to the third sub-pixels and the expansion coefficient $\alpha$, so that the boundary between the fourth sub-pixel 49W and the third sub-pixel 49B adjacent thereto can be preferably prevented from being visually recognized even in such a pixel array. However, the pixel array of the display device 10 according to the embodiment is not limited thereto. The display device 10 according to the embodiment can preferably prevent the boundary between the fourth sub-pixel 49W and the other sub-pixels adjacent thereto from being visually recognized so long as the fourth sub-pixel 49W and the other sub-pixels are alternately arranged. Next, the following describes another example of the pixel array.

Example of Pixel Array

Figure 10A:
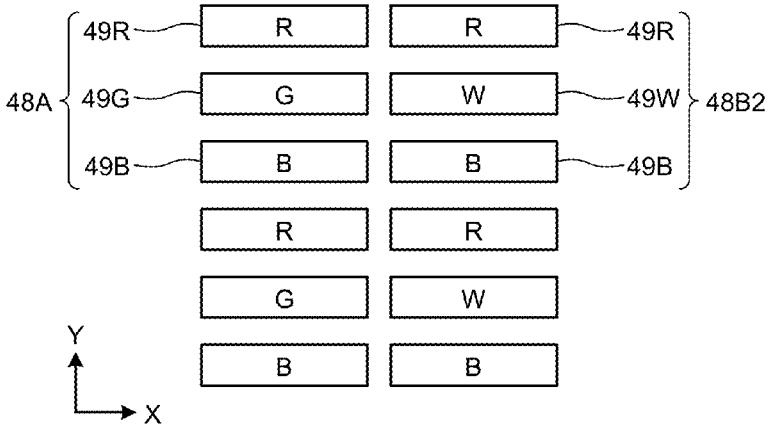
FIG. 10A is a diagram illustrating another example of the pixel array of the image display panel.
Figure 10B:
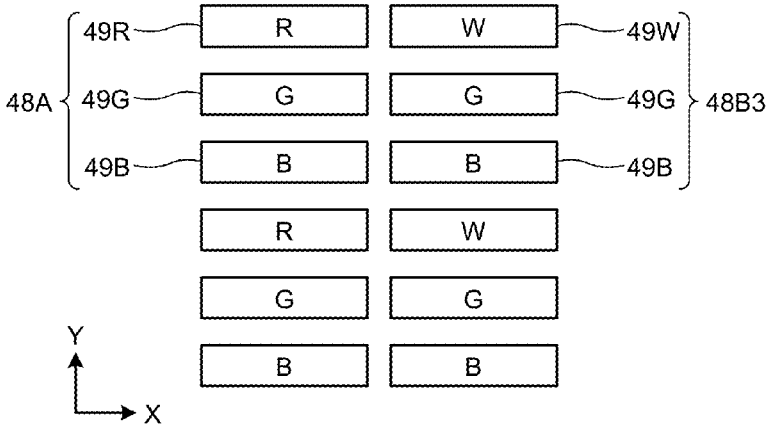
FIG. 10B is a diagram illustrating another example of the pixel array of the image display panel.
Figure 10C:
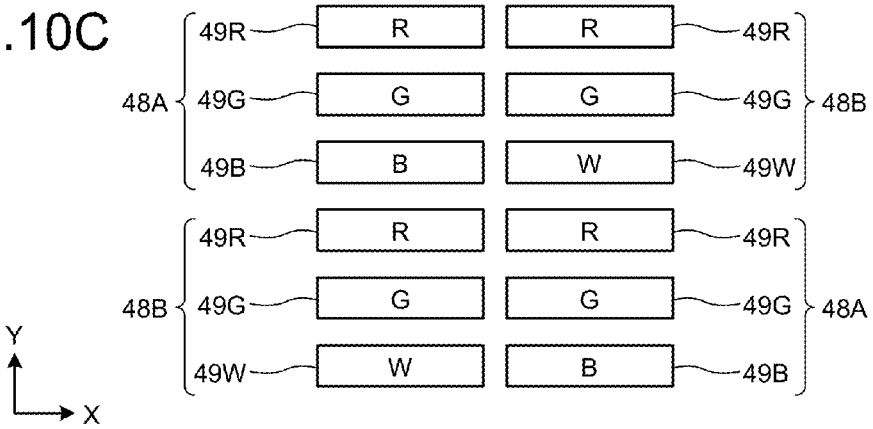
FIG. 10C is a diagram illustrating another example of the pixel array of the image display panel.

FIGS. 10A to 10C are diagrams illustrating other examples of the pixel array of the image display panel. The pixel array illustrated in FIG. 10A is different from that of the image display panel 40 according to the embodiment in that a pixel 48B2 is applied instead of the pixel 48B. The pixel 48B2 is different from the pixel 48B according to the embodiment in that the pixel 48B2 includes the first sub-pixel 49R, the fourth sub-pixel 49W, and the third sub-pixel 49B. The pixel array illustrated in FIG. 10B is different from that of the image display panel 40 according to the embodiment in that a pixel 48B3 is applied instead of the pixel 48B. The pixel 48B3 is different from the pixel 48B according to the embodiment in that the pixel 48B3 includes the fourth sub-pixel 49W, the second sub-pixel 49G, and the third sub-pixel 49B.

The pixel array illustrated in FIG. 10C is different from the pixel array of the image display panel 40 according to the embodiment in the following point. That is, in the pixel array illustrated in FIG. 10C, the pixel 48A and the pixel 48B are alternately arranged in a row direction and a column direction. In the pixel array illustrated in FIG. 10C, the third sub-pixel 49B and the fourth sub-pixel 49W are alternately arranged in the column direction in the third row, and the third sub-pixel 49B and the fourth sub-pixel 49W are alternately placed in the column direction in the same row of the third row.

FIGS. 11A to 11D are diagrams illustrating other examples of the pixel array of the image display panel. The pixel array illustrated in FIGS. 11A to 11D is different from the pixel array of the image display panel 40 according to the embodiment in that each of a first sub-pixel 49Ra, a second sub-pixel 49Ga, a third sub-pixel 49Ba, and a fourth sub-pixel 49Wa has a rectangular shape the length of which in the Y-axis direction is larger than the length of which in the X-axis direction.

Figure 11A:
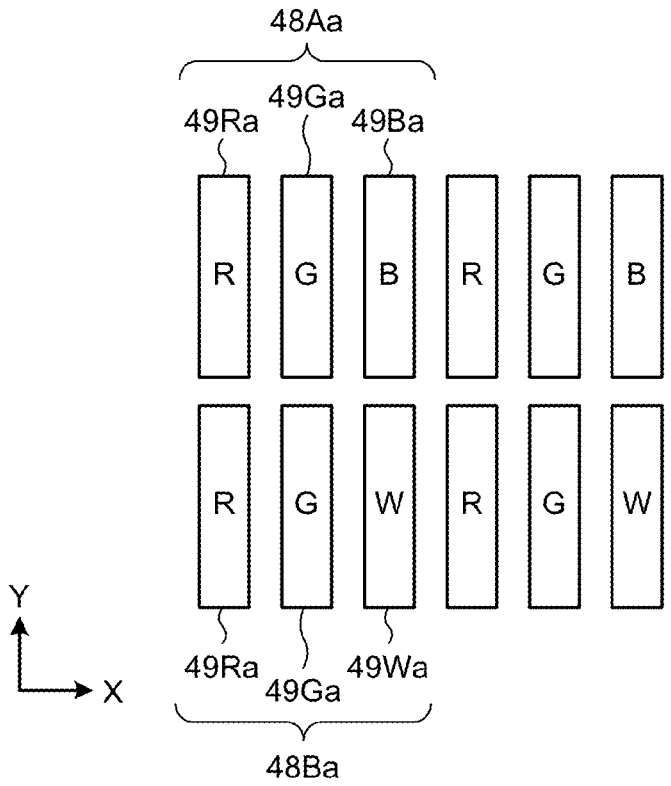
FIG. 11A is a diagram illustrating another example of the pixel array of the image display panel.

In the pixel array illustrated in FIG. 11A, a pixel 48Aa including the first sub-pixel 49Ra, the second sub-pixel 49Ga, and the third sub-pixel 49Ba and a pixel 48Ba including the first sub-pixel 49Ra, the second sub-pixel 49Ga, and the fourth sub-pixel 49Wa are alternately arranged in the Y-axis direction. In the pixel array illustrated in FIG. 11A, the pixel 48Aa is arranged in the X-axis direction, and the pixel 48Ba is arranged in the X-axis direction. In the pixel array illustrated in FIG. 11A, the first column in which first sub-pixels 49Ra are arranged, the second column arranged next to the first column in which second sub-pixels 49Ga are arranged, and the third column arranged next to the second column are repeatedly arranged. In the third column, the third sub-pixel 49Ba and the fourth sub-pixel 49Wa are alternately arranged in the column direction.

Figure 11B:
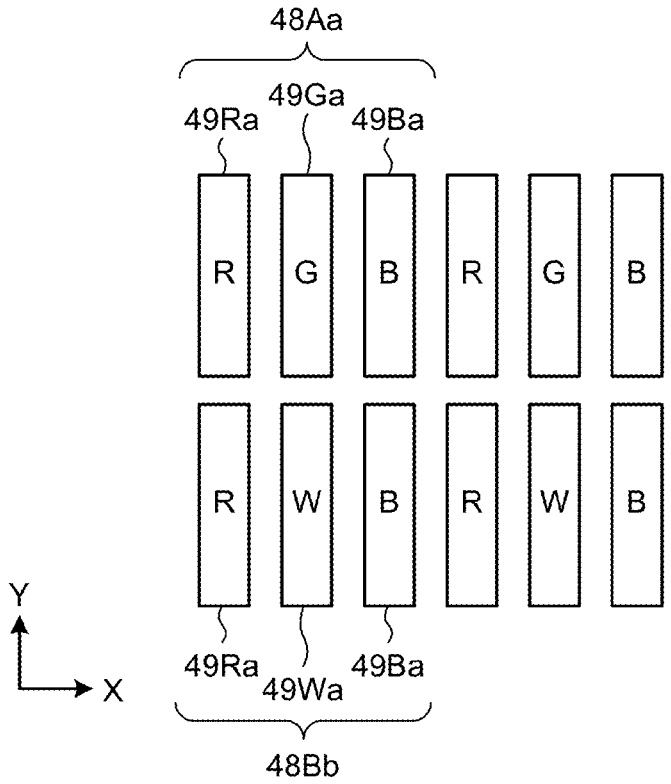
FIG. 11B is a diagram illustrating another example of the pixel array of the image display panel.
Figure 11C:
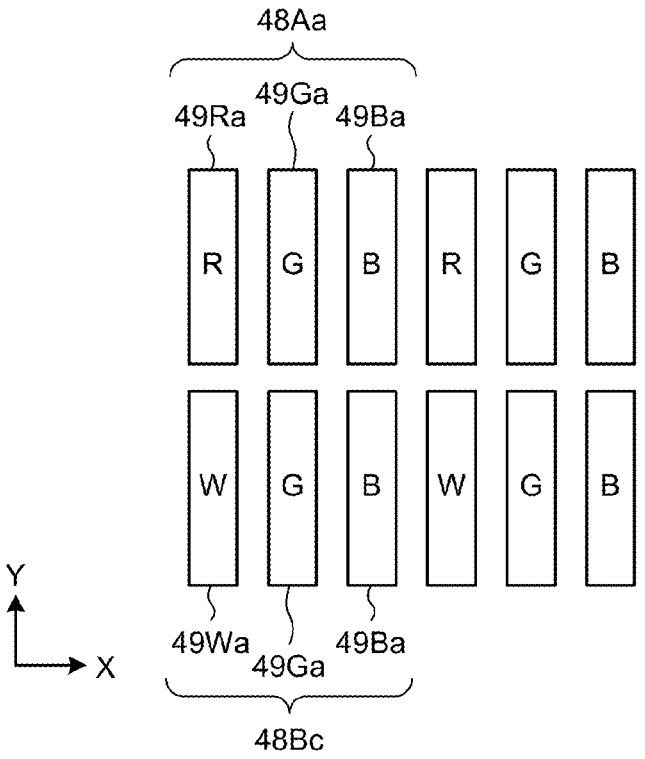
FIG. 11C is a diagram illustrating another example of the pixel array of the image display panel.

The pixel array illustrated in FIG. 11B is different from the pixel array in FIG. 11A in that a pixel 48Bb is applied instead of the pixel 48Ba. The pixel 48Bb is different from the pixel 48Ba in FIG. 11A in that the pixel 48Bb includes the first sub-pixel 49Ra, the fourth sub-pixel 49Wa, and the third sub-pixel 49Ba. The pixel array illustrated in FIG. 11C is different from the pixel array in FIG. 11A in that a pixel 48Bc is applied instead of the pixel 48Ba. The pixel 48Bc is different from the pixel 48Ba in FIG. 11A in that the pixel 48Bc includes the fourth sub-pixel 49Wa, the second sub-pixel 49Ga, and the third sub-pixel 49Ba.

Figure 11D:
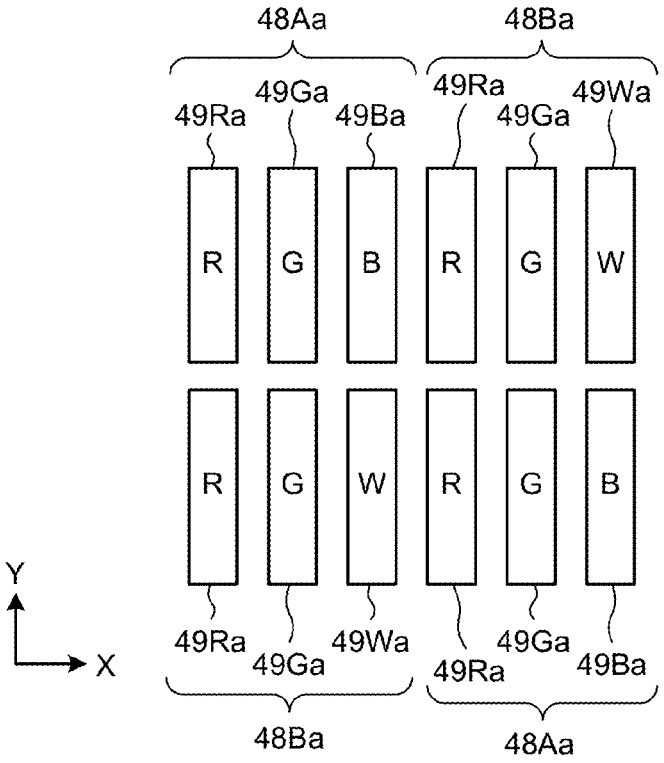
FIG. 11D is a diagram illustrating another example of the pixel array of the image display panel.

The pixel array illustrated in FIG. 11D is different from the pixel array in FIG. 11A in the following point. That is, in the pixel array illustrated in FIG. 11D, the pixel 48Aa and the pixel 48Ba are alternately arranged in the row direction and the column direction. In the pixel array illustrated in FIG. 11D, the third sub-pixel 49Ba and the fourth sub-pixel 49Wa are alternately arranged in the column direction in the third column, and the third sub-pixel 49B and the fourth sub-pixel 49W are alternately placed in the row direction in the same column in the third column. However, another example of the pixel array is not limited thereto.

2. Application Example

Next, the following describes an electronic apparatuses including the display device 10 according to the embodiment described above and a control device that controls the display device 10 with reference to FIGS. 12 to 18. FIGS. 12 to 18 are diagrams illustrating examples of the electronic apparatus including the display device according to the embodiment. The display device 10 can be applied to electronic apparatuses in various fields such as television apparatuses, digital cameras, notebook-type personal computers, portable electronic apparatuses such as mobile phones, and video cameras. In other words, the display device 10 can be applied to electronic apparatuses in various fields that display a video signal input from the outside or a video signal generated inside as an image or video. Each of such electronic apparatuses includes a control device that supplies an input signal to the display device 10.

Application Example 1

Figure 12:
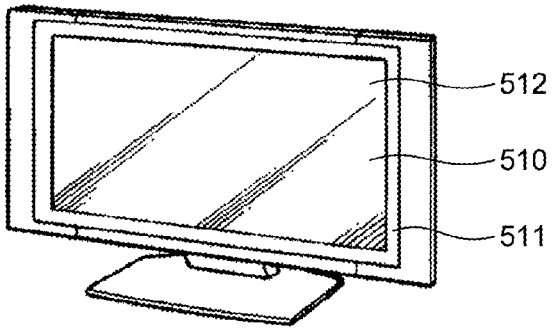
FIG. 12 is a diagram illustrating an example of an electronic apparatus including the display device according to the embodiment.

An electronic apparatus illustrated in FIG. 12 is a television apparatus to which the display device 10 is applied. The television apparatus has, for example, a video display screen unit 510 including a front panel 511 and a filter glass 512, and the display device 10 is applied to the video display screen unit 510. The screen of the television apparatus may have a function of detecting a touch operation in addition to a function of displaying an image.

Application Example 2

Figure 13:
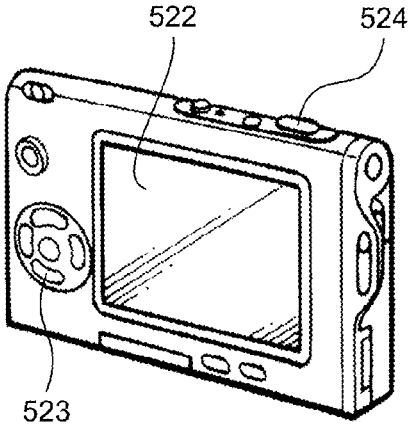
FIG. 13 is a diagram illustrating an example of the electronic apparatus including the display device according to the embodiment.

An electronic apparatus illustrated in FIG. 13 is a digital camera to which the display device 10 is applied. The digital camera includes, for example, a display unit 522, a menu switch 523, and a shutter button 524, and the display device 10 is applied to the display unit 522. The display unit 522 of the digital camera may have a function of detecting a touch operation in addition to a function of displaying an image.

Application Example 3

Figure 14:
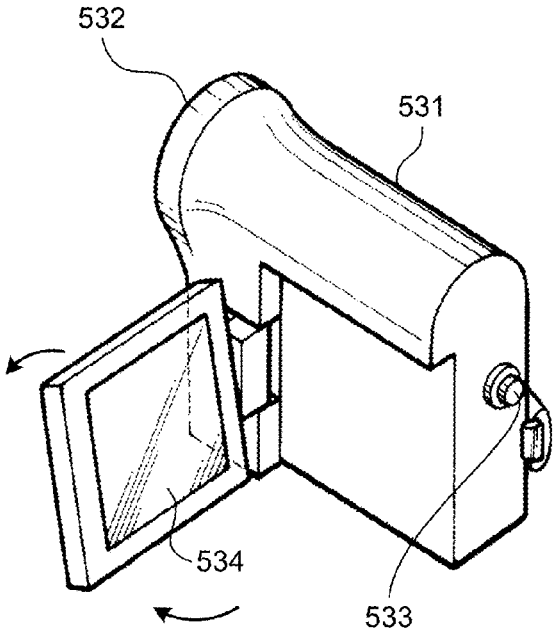
FIG. 14 is a diagram illustrating an example of the electronic apparatus including the display device according to the embodiment.

An electronic apparatus illustrated in FIG. 14 represents an external appearance of a video camera to which the display device 10 is applied. The video camera includes, for example, a main body part 531, a lens 532 for shooting a subject arranged on a front side surface of the main body part 531, a start/stop switch 533 in shooting, and a display unit 534. The display device 10 is applied to the display unit 534. The display unit 534 of the video camera may have a function of detecting a touch operation in addition to a function of displaying an image.

Application Example 4

Figure 15:
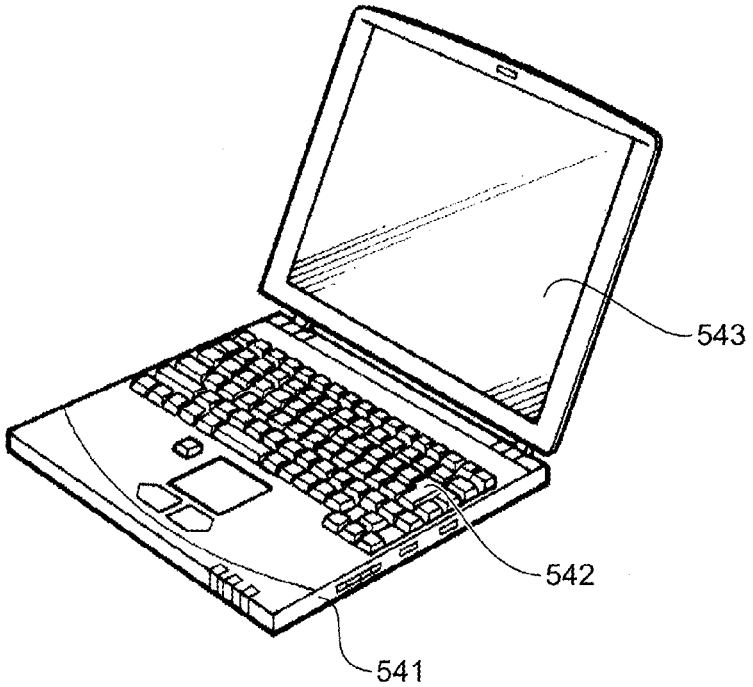
FIG. 15 is a diagram illustrating an example of the electronic apparatus including the display device according to the embodiment.

An electronic apparatus illustrated in FIG. 15 is a notebook-type personal computer to which the display device 10 is applied. The notebook-type personal computer includes, for example, a main body 541, a keyboard 542 for inputting characters and the like, and a display unit 543 that displays an image. The display device 10 is applied to the display unit 543. The display unit 543 of the notebook-type personal computer may have a function of detecting a touch operation in addition to a function of displaying an image.

Application Example 5

Figure 16:
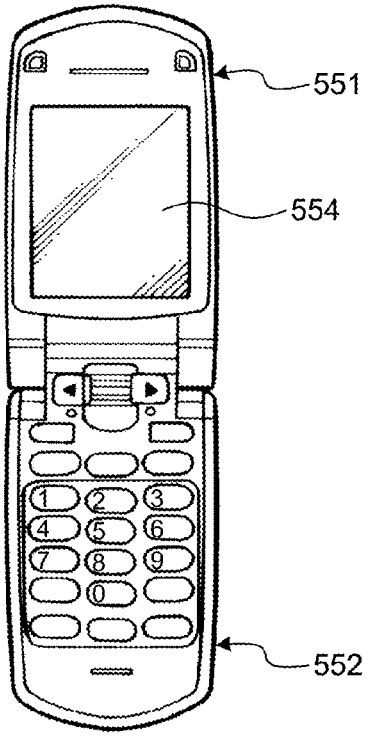
FIG. 16 is a diagram illustrating an example of the electronic apparatus including the display device according to the embodiment.

An electronic apparatus illustrated in FIG. 16 is a mobile phone to which the display device 10 is applied. The mobile phone is made, for example, by connecting an upper housing 551 to a lower housing 552 with a connecting part (hinge part), and includes a display device 554. The display device 10 is mounted as the display device 554. The display device 554 of the mobile phone may have a function of detecting a touch operation in addition to a function of displaying an image.

Application Example 6

Figure 17:
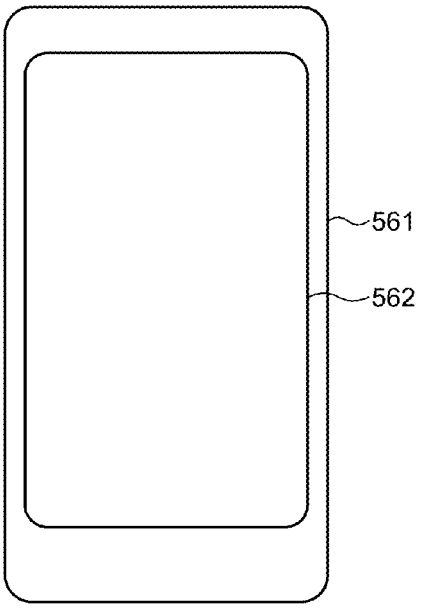
FIG. 17 is a diagram illustrating an example of the electronic apparatus including the display device according to the embodiment.

An electronic apparatus illustrated in FIG. 17 is a mobile phone, what is called a smartphone, to which the display device 10 and the like are applied. The mobile phone includes, for example, a touch panel 562 on a surface of a thin plate-shaped housing 561 having a substantially rectangular shape. The touch panel 562 includes the display device 10 and the like.

Application Example 7

Figure 18:
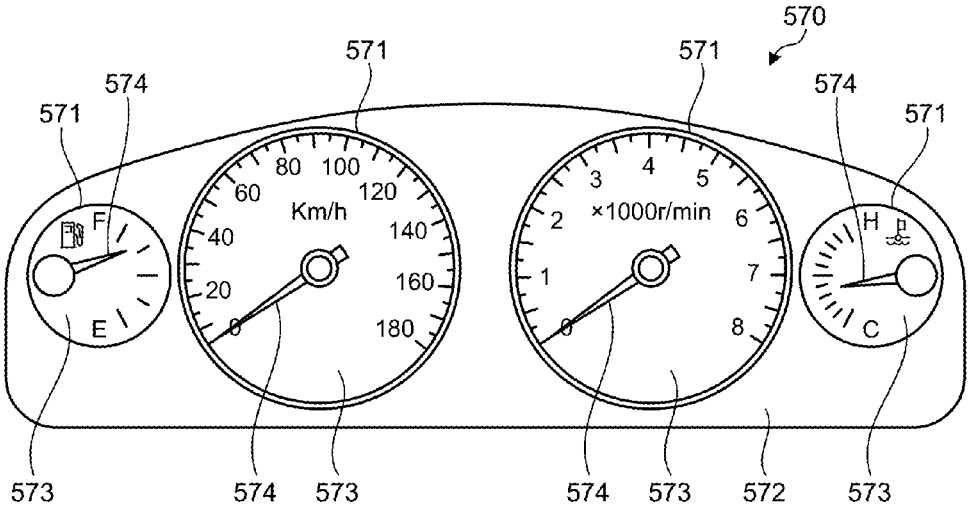
FIG. 18 is a diagram illustrating an example of the electronic apparatus including the display device according to the embodiment.

An electronic apparatus illustrated in FIG. 18 is a meter unit mounted on a vehicle. A meter unit (electronic apparatus) 570 illustrated in FIG. 18 includes a plurality of liquid crystal display devices 571 such as a fuel gauge, a water-temperature gauge, a speedometer, and a tachometer. The liquid crystal display devices 571 are collectively covered with an exterior panel 572.

Each of the liquid crystal display devices 571 illustrated in FIG. 18 is configured by combining a liquid crystal panel 573 serving as a liquid crystal display module with a movement mechanism serving as an analog display module. The movement mechanism includes a motor serving as a driving module and an indicator 574 rotated by the motor. As illustrated in FIG. 18, in the liquid crystal display device 571, scales, warning, and the like can be displayed on a display surface of the liquid crystal panel 573, and the indicator 574 of the movement mechanism can rotate on a display surface side of the liquid crystal panel 573. The display device 10 according to the embodiment is applied to the liquid crystal display device 571.

A plurality of liquid crystal display devices 571 are arranged on one exterior panel 572 in FIG. 18. However, the embodiment is not limited thereto. One liquid crystal display device may be arranged in a region surrounded by an exterior panel, and the liquid crystal display device may display a fuel gauge, a water-temperature gauge, a speedometer, a tachometer, and the like.

The embodiment according to the present invention has been described above. However, the embodiment is not limited to content thereof. The components described above include a component that is easily conceivable by those skilled in the art, substantially the same component, and what is called an equivalent. The components described above can also be appropriately combined with each other. In addition, the components can be variously omitted, replaced, or modified without departing from the gist of the embodiment and the like described above. For example, the display device 10 may include a self-luminous image display panel in which a self-luminous body such as an organic light emitting diode (OLED) is lit.

According to the embodiment, the present disclosure includes the following aspects.

(1) A display device including:

an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that converts an input value of an input signal into an extended value in a color space extended with the first color, the second color, the third color, and the fourth color to be generated, and outputs a generated output signal to the image display panel, wherein the signal processing unit determines an expansion coefficient related to the image display panel, obtains an output signal of the first sub-pixel based on at least an input signal of the first sub-pixel and the expansion coefficient to be output to the first sub-pixel, obtains an output signal of the second sub-pixel based on at least an input signal of the second sub-pixel and the expansion coefficient to be output to the second sub-pixel, obtains an output signal of the third sub-pixel based on at least an input signal of the third sub-pixel and the expansion coefficient to be output to the third sub-pixel, obtains a fourth sub-pixel correction value as a correction value of an output signal of the fourth sub-pixel based on the input signal of the first sub-pixel, the input signal of the second sub-pixel, the input signal of the third sub-pixel, and the expansion coefficient, and obtains the output signal of the fourth sub-pixel based on the input signal of the first sub-pixel, the input signal of the second sub-pixel, the input signal of the third sub-pixel, the expansion coefficient, and the fourth sub-pixel correction value to be output to the fourth sub-pixel.

(2) The display device according to (1), wherein the signal processing unit obtains the fourth sub-pixel correction value based on a maximum value among a signal value of the input signal of the first sub-pixel, a signal value of the input signal of the second sub-pixel, and a signal value of the input signal of the third sub-pixel, and a minimum value among the signal value of the input signal of the first sub-pixel, the signal value of the input signal of the second sub-pixel, and the signal value of the input signal of the third sub-pixel.

(3) The display device according to (2), wherein the fourth sub-pixel correction value increases as the expansion coefficient increases, and the output signal of the fourth sub-pixel increases as the fourth sub-pixel correction value increases.

(4) The display device according to (3), wherein the fourth sub-pixel correction value increases as a difference between the maximum value and the minimum value increases.

(5) The display device according to (4), wherein the fourth sub-pixel correction value is calculated using the following expression:

$$WG=a\cdot(\mathrm{Max}-1/\alpha)/\mathrm{Min}+b,$$

where the fourth sub-pixel correction value is WG, the expansion coefficient is $\alpha$, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and predetermined coefficient values are a and b.

(6) The display device according to (4), wherein the fourth sub-pixel correction value is calculated using the following expression:

$$WG=a\cdot(\text{Max}-\text{Min})+(1-1/\alpha)+b,$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and predetermined coefficient values are a and b.

(7) The display device according to (4), wherein the fourth sub-pixel correction value is calculated using the following expression:

$$WG=a\cdot\{(\text{Max}-\text{Min})+(1-1/\alpha)\},$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and a predetermined coefficient value is a.

(8) The display device according to (4), wherein the fourth sub-pixel correction value is calculated using the following expression:

$$WG=a\cdot\alpha^{C}\cdot(\text{Max}-\text{Min})^{d}+(1-1/\alpha)+b,$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and predetermined coefficient values are a, b, c, and d.

(9) The display device according to (1), wherein the image display panel includes an array of the pixels in which a first row including the first sub-pixel, a second row that is arranged next to the first row and includes the second sub-pixel, and a third row that is arranged next to the second row and includes the third sub-pixel and the fourth sub-pixel alternately placed in a row direction, are periodically arranged.

(10) The display device according to (1), further including:

a light source unit that irradiates the image display panel with illumination light based on an illumination light control signal from the signal processing unit.

(11) The display device according to (1), wherein the fourth color is white.

(12) An electronic apparatus including:

the display device according to any one of (1) to (11); and a control device that supplies the input signal to the display device.

(13) A method of driving a display device, the display device including an image display panel including a plurality of pixels each including a first sub-pixel that displays a first color, a second sub-pixel that displays a second color, a third sub-pixel that displays a third color, and a fourth sub-pixel that displays a fourth color, the method including:

obtaining an output signal of each of the first sub-pixel, the second sub-pixel, the third sub-pixel, and the fourth sub-pixel; and controlling an operation of each of the first sub-pixel, the second sub-pixel, the third sub-pixel, and the fourth sub-pixel based on the output signal, wherein at obtaining the output signal, an expansion coefficient related to the image display panel is determined, the output signal of the first sub-pixel is obtained based on at least an input signal of the first sub-pixel and the expansion coefficient, the output signal of the second sub-pixel is obtained based on at least an input signal of the second sub-pixel and the expansion coefficient, the output signal of the third sub-pixel is obtained based on at least an input signal of the third sub-pixel and the expansion coefficient, a fourth sub-pixel correction value as a correction value of an output signal of the fourth sub-pixel is obtained based on the input signal of the first sub-pixel, the input signal of the second sub-pixel, the input signal of the third sub-pixel, and the expansion coefficient, and the output signal of the fourth sub-pixel is obtained based on the input signal of the first sub-pixel, the input signal of the second sub-pixel, the input signal of the third sub-pixel, the expansion coefficient, and the fourth sub-pixel correction value.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that converts an input value of an input signal into an extended value in a color space extended with the first color, the second color, the third color, and the fourth color to be generated, and outputs a generated output signal to the image display panel, wherein the signal processing unit determines an expansion coefficient related to the image display panel, obtains an output signal of the first sub-pixel based on at least an input signal of the first sub-pixel and the expansion coefficient to be output to the first sub-pixel, obtains an output signal of the second sub-pixel based on at least an input signal of the second sub-pixel and the expansion coefficient to be output to the second sub-pixel, obtains an output signal of the third sub-pixel based on at least an input signal of the third sub-pixel and the expansion coefficient to be output to the third sub-pixel, obtains a fourth sub-pixel correction value as a correction value of an output signal of the fourth sub-pixel based on the input signal of the first sub-pixel, the input signal of the second sub-pixel, the input signal of the third sub-pixel, and the expansion coefficient, and obtains the output signal of the fourth sub-pixel based on the input signal of the first sub-pixel, the input signal of the second sub-pixel, the input signal of the third sub-pixel, the expansion coefficient, and the fourth sub-pixel correction value to be output to the fourth sub-pixel.

2. The display device according to claim 1, wherein the signal processing unit obtains the fourth sub-pixel correction value based on a maximum value among a signal value of the input signal of the first sub-pixel, a signal value of the input signal of the second sub-pixel, and a signal value of the input signal of the third sub-pixel, and a minimum value among the signal value of the input signal of the first sub-pixel, the signal value of the input signal of the second sub-pixel, and the signal value of the input signal of the third sub-pixel.

3. The display device according to claim 2, wherein the fourth sub-pixel correction value increases as the expansion coefficient increases, and the output signal of the fourth sub-pixel increases as the fourth sub-pixel correction value increases.

4. The display device according to claim 3, wherein the fourth sub-pixel correction value increases as a difference between the maximum value and the minimum value increases.

5. The display device according to claim 4, wherein the fourth sub-pixel correction value is calculated using the following expression:

$$WG=a\cdot(\mathrm{Max}-1/\alpha)/\mathrm{Min}+b,$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and predetermined coefficient values are a and b.

6. The display device according to claim 4, wherein the fourth sub-pixel correction value is calculated using the following expression:

$$WG=a\cdot(\mathrm{Max}-\mathrm{Min})+(1-1/\alpha)+b,$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and predetermined coefficient values are a and b.

7. The display device according to claim 4, wherein the fourth sub-pixel correction value is calculated using the following expression:

$$WG=a\cdot\{(\mathrm{Max}-\mathrm{Min})+(1-1/\alpha)\},$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and a predetermined coefficient value is a.

8. The display device according to claim 4, wherein the fourth sub-pixel correction value is calculated using the following expression:

$$WG=a\cdot\alpha^{C}\cdot(\mathrm{Max}-\mathrm{Min})^{d}+(1-1/\alpha)+b,$$

where the fourth sub-pixel correction value is WG, the expansion coefficient is α, the maximum value among the signal value of the input signal of the first sub-pixel, the signal value of the input signal of the second sub-pixel, and the signal value of the input signal of the third sub-pixel is Max, the minimum value among the signal value of the input signal of the first sub-pixel, the signal value of the input signal of the second sub-pixel, and the signal value of the input signal of the third sub-pixel is Min, and predetermined coefficient values are a, b, c, and d.

9. The display device according to claim 1, wherein the image display panel includes an array of the pixels in which a first row including the first sub-pixel, a second row that is arranged next to the first row and includes the second sub-pixel, and a third row that is arranged next to the second row and includes the third sub-pixel and the fourth sub-pixel alternately placed in a row direction, are periodically arranged.

10. The display device according to claim 1, further comprising:

a light source unit that irradiates the image display panel with illumination light based on an illumination light control signal from the signal processing unit.

11. The display device according to claim 1, wherein the fourth color is white.

12. An electronic apparatus comprising:

a display device; and a control device that supplies an input signal to the display device, wherein the display device includes:

an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that converts an input value of the input signal into an extended value in a color space extended with the first color, the second color, the third color, and the fourth color to be generated, and outputs a generated output signal to the image display panel, the signal processing unit determines an expansion coefficient related to the image display panel, obtains an output signal of the first sub-pixel based on at least an input signal of the first sub-pixel and the expansion coefficient to be output to the first sub-pixel, obtains an output signal of the second sub-pixel based on at least an input signal of the second sub-pixel and the expansion coefficient to be output to the second sub-pixel, obtains an output signal of the third sub-pixel based on at least an input signal of the third sub-pixel and the expansion coefficient to be output to the third sub-pixel, obtains a fourth sub-pixel correction value as a correction value of an output signal of the fourth sub-pixel based on the input signal of the first sub-pixel, the input signal of the second sub-pixel, the input signal of the third sub-pixel, and the expansion coefficient, and obtains the output signal of the fourth sub-pixel based on the input signal of the first sub-pixel, the input signal of the second sub-pixel, the input signal of the third sub-pixel, the expansion coefficient, and the fourth sub-pixel correction value to be output to the fourth sub-pixel.

13. A method of driving a display device, the display device comprising an image display panel including a plurality of pixels each including a first sub-pixel that displays a first color, a second sub-pixel that displays a second color, a third sub-pixel that displays a third color, and a fourth sub-pixel that displays a fourth color, the method comprising:

obtaining an output signal of each of the first sub-pixel, the second sub-pixel, the third sub-pixel, and the fourth sub-pixel; and controlling an operation of each of the first sub-pixel, the second sub-pixel, the third sub-pixel, and the fourth sub-pixel based on the output signal, wherein at obtaining the output signal, an expansion coefficient related to the image display panel is determined, the output signal of the first sub-pixel is obtained based on at least an input signal of the first sub-pixel and the expansion coefficient, the output signal of the second sub-pixel is obtained based on at least an input signal of the second sub-pixel and the expansion coefficient, the output signal of the third sub-pixel is obtained based on at least an input signal of the third sub-pixel and the expansion coefficient, a fourth sub-pixel correction value as a correction value of an output signal of the fourth sub-pixel is obtained based on the input signal of the first sub-pixel, the input signal of the second sub-pixel, the input signal of the third sub-pixel, and the expansion coefficient, and the output signal of the fourth sub-pixel is obtained based on the input signal of the first sub-pixel, the input signal of the second sub-pixel, the input signal of the third sub-pixel, the expansion coefficient, and the fourth sub-pixel correction value.

* * * * *